US011813848B2

(12) United States Patent
Miyake et al.

(10) Patent No.: US 11,813,848 B2
(45) Date of Patent: Nov. 14, 2023

(54) IMAGE FORMING APPARATUS

(71) Applicant: SEIKO EPSON CORPORATION, Tokyo (JP)

(72) Inventors: Toshio Miyake, Shiojiri (JP); Masaki Ichikawa, Matsumoto (JP)

(73) Assignee: WORKMAN NYDEGGER

( * ) Notice: Subject to any disclaimer, the term of this patent is extended or adjusted under 35 U.S.C. 154(b) by 0 days.

(21) Appl. No.: 18/179,523

(22) Filed: Mar. 7, 2023

(65) Prior Publication Data

US 2023/0202206 A1 Jun. 29, 2023

Related U.S. Application Data

(63) Continuation of application No. 17/443,665, filed on Jul. 27, 2021, now Pat. No. 11,613,134.

(30) Foreign Application Priority Data

Jul. 30, 2020 (JP) ..... 2020-129349

(51) Int. Cl.
*B41J 29/02* (2006.01)
*B41J 11/00* (2006.01)

(52) U.S. Cl.
CPC ..... *B41J 11/005* (2013.01)

(58) Field of Classification Search
None
See application file for complete search history.

(56) References Cited

U.S. PATENT DOCUMENTS

2015/0246565 A1* 9/2015 Takabatake ..... B41J 29/13 347/104
2016/0052735 A1 2/2016 Tahara et al.
2017/0120644 A1* 5/2017 Oguchi ..... B41J 11/04
2017/0120645 A1* 5/2017 Ishikawa ..... B41J 11/04
2018/0034986 A1 2/2018 Ishida et al.

FOREIGN PATENT DOCUMENTS

JP 2002-347996 A 12/2002
JP 2018-016050 A 2/2018

* cited by examiner

*Primary Examiner* — Scott A Richmond
(74) *Attorney, Agent, or Firm* — WORKMAN NYDEGGER

(57) ABSTRACT

A printer includes a printer body, a hopper, an open-and-close cover, a paper support, and a support holder. The hopper pushes paper up while supporting the paper. The open-and-close cover is able to be opened from and closed toward the printer body. The paper support is provided in such a way as to be able to be housed inside and drawn away from the open-and-close cover, and is configured to support the paper by being drawn out. The support holder supports the paper, together with the hopper and the paper support. The support holder switches between an upright orientation for being housed into the printer body and a tilted orientation for supporting the paper together with the hopper and the paper support by the opening and closing of the open-and-close cover.

7 Claims, 20 Drawing Sheets

IMAGE FORMING APPARATUS

The present application is a continuation of U.S. patent application Ser. No. 17/443,665, filed Jul. 27, 2021, which is based on, and claims priority from JP Application Serial Number 2020-129349, filed Jul. 30, 2020, the disclosure of which is hereby incorporated by reference herein in its entirety.

BACKGROUND

1. Technical Field

Embodiments of the present disclosure relate to an image forming apparatus.

2. Related Art

An image forming apparatus disclosed in JP-A-2018-016050 is equipped with a sheet feeder tray. The sheet feeder tray is housed perpendicularly in the rear portion of the apparatus. When the sheet feeder tray is drawn out upward and tilted back obliquely, its body becomes exposed, and a sheet placement surface that is inclined with respect to the horizontal plane is formed. The tray body is configured such that its sheet stacking surface can be made wider by slide extension operation.

In the structure disclosed in JP-A-2018-016050, since the range in which the tray body is able to be slid is limited, when large-sized sheets are supported by the sheet feeder tray, there is a risk that the area for supporting the sheets could be insufficient.

If the size of the sheet feeder tray is increased in order to support large-sized sheets, the size of a space for housing the sheet feeder tray also needs to be increased, resulting in an increase in the size of an image forming apparatus.

SUMMARY

An image forming apparatus according to a certain aspect of the present disclosure includes: an apparatus body that includes an image forming unit that forms an image on a medium; a pushing-up member that is provided rotatably on the apparatus body and is configured to push the medium up while supporting the medium; an open-and-close member that is provided on the apparatus body and is configured to be opened from and closed toward the apparatus body; a medium supporting member that is configured to be housed inside and drawn out from the open-and-close member, the medium supporting member being configured to support the medium when the open-and-close member is in an open state in which the open-and-close member is opened from the apparatus body and the medium supporting member is drawn out; and an assisting support member that is provided rotatably on the apparatus body and is configured to support the medium together with the pushing-up member and the medium supporting member, wherein the assisting support member is configured to switch between a first state in which the assisting support member is housed into the apparatus body and a second state in which the assisting support member supports the medium together with the pushing-up member and the medium supporting member, and the assisting support member switches between the first state and the second state by opening and closing of the open-and-close member.

DESCRIPTION OF EXEMPLARY EMBODIMENTS

Figure 1:
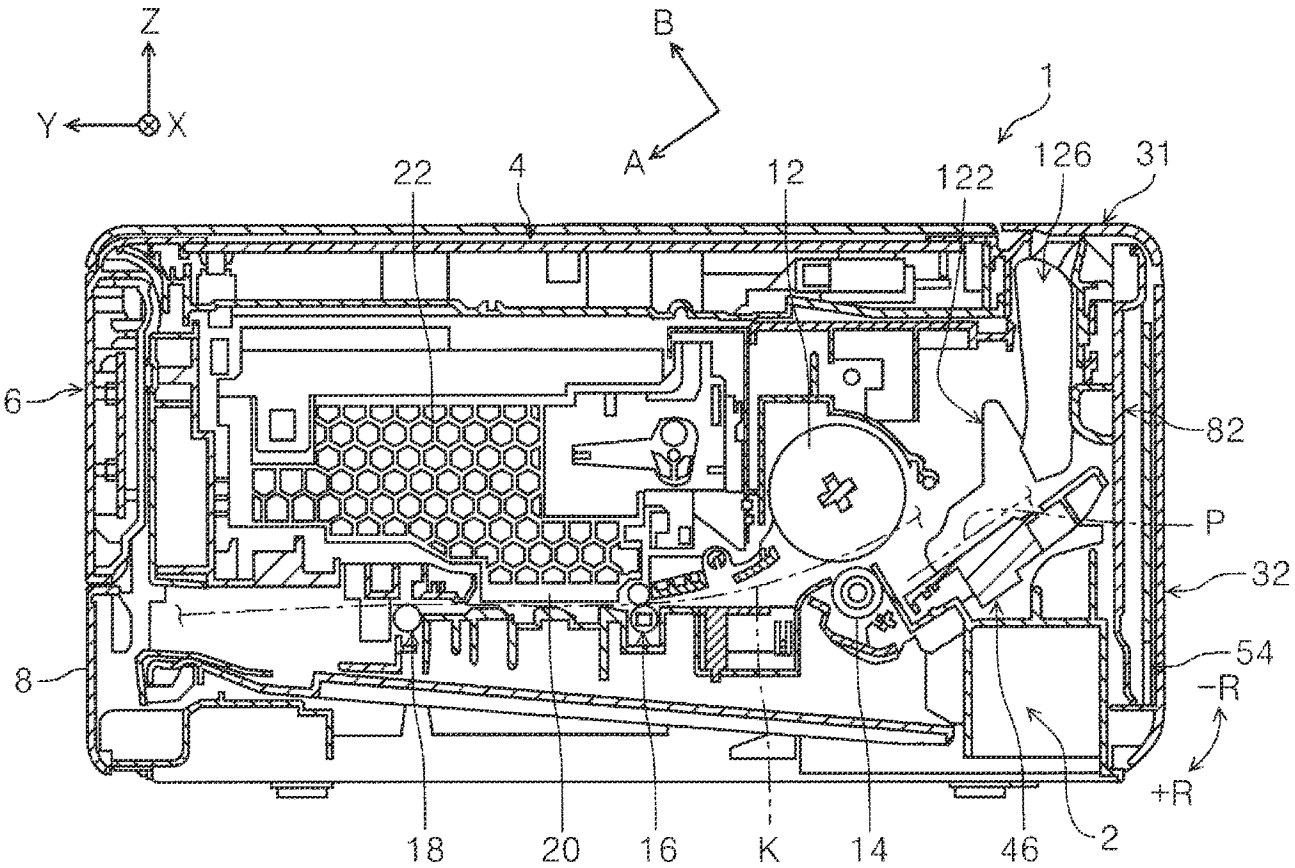
FIG. 1 is a cross-sectional side view of a printer when an open-and-close cover is in a closed state.

First, a brief overview of an image forming apparatus according to the present disclosure is presented below.

An image forming apparatus according to a first aspect includes: an apparatus body that includes an image forming unit that forms an image on a medium; a pushing-up member that is provided rotatably on the apparatus body and is configured to push the medium up while supporting the medium; an open-and-close member that is provided on the apparatus body and is configured to be opened from and closed toward the apparatus body; a medium supporting member that is configured to be housed inside and drawn out from the open-and-close member, the medium supporting member being configured to support the medium when the open-and-close member is in an open state in which the open-and-close member is opened from the apparatus body and the medium supporting member is drawn out; and an assisting support member that is provided rotatably on the apparatus body and is configured to support the medium together with the pushing-up member and the medium supporting member, wherein the assisting support member is configured to switch between a first state in which the assisting support member is housed into the apparatus body and a second state in which the assisting support member supports the medium together with the pushing-up member and the medium supporting member, and the assisting support member switches between the first state and the second state by opening and closing of the open-and-close member.

According to the present aspect, the medium supporting member becomes able to support the medium by being drawn out when the open-and-close member is in the open state.

The assisting support member is rotated to switch from the first state, which is its orientation when housed, to the second state, which is its orientation when drawn out, and supports the medium together with the pushing-up member and the medium supporting member.

Since the assisting support member is switched into the second state by rotation as stated above, the area where it is possible to support the medium is wider as compared with a structure that is not equipped with the assisting support member. Therefore, it is possible to prevent the shortage of the area for supporting the medium.

Closing the open-and-close member causes the assisting support member to switch from the second state to the first state and to be housed into the apparatus body. As compared with a structure in which the assisting support member and the medium supporting member are configured integrally, the space required for housing the assisting support member and the medium supporting member inside the apparatus body can be reduced. Since a smaller space is sufficient, it is possible to prevent the size of the image forming apparatus from increasing.

A second aspect is that, in the first aspect, the image forming apparatus further may include: a guiding member that is provided on the open-and-close member and is configured to move in a drawn-out direction in which the medium supporting member is drawn out; wherein the medium supporting member is configured to be housed inside, and drawn out from the open-and-close member via the guiding member.

According to the present aspect, the guiding member is moved in relation to the open-and-close member, and the medium supporting member is drawn out in relation to the guiding member. Therefore, as compared with a structure in which the medium supporting member is drawn out directly from the open-and-close member, it is possible to cause the medium supporting member to move to a higher position. This makes it possible to increase the size of the area where the medium is supported.

The image forming apparatus according to a third aspect is configured such that, in the second aspect, the guiding member may include a guide section that guides a lower end portion of a first supporting surface of the medium supporting member to a position in which the lower end portion is continuous from an upper end portion of a second supporting surface of the assisting support member.

According to the present aspect, when the medium supporting member is drawn out, the lower end portion of the first supporting surface of the medium supporting member is guided to a position that is continuous from the upper end portion of the second supporting surface. That is, the medium supporting member approaches the assisting support member. Therefore, it is possible to make the gap between the assisting support member and the medium supporting member narrower.

The image forming apparatus according to a fourth aspect may be configured such that, in the third aspect, the guide section is a guiding groove that guides the medium supporting member to a drawn-out position, and the guiding member includes a pivotal portion that rotatably supports the medium supporting member when the medium supporting member is drawn out.

According to the present aspect, the medium supporting member is guided to the drawn-out position along the guiding groove. As a result, the medium supporting member approaches the assisting support member.

Moreover, since the state of the medium supporting member is changed in such a way as to approach the assisting support member by being rotated around the center axis of the pivotal portion, it is possible to further reduce the gap between the assisting support member and the medium supporting member.

The pivotal portion may be located at a position higher than a top of the apparatus in an apparatus height direction when the medium supporting member is located at the drawn-out position and is in a tilted orientation for supporting the medium.

The image forming apparatus according to a fifth aspect may be configured such that, in the fourth aspect, the guiding groove has a sloped portion that extends in a direction intersecting with the drawn-out direction and causes the medium supporting member to approach the assisting support member when the medium supporting member is drawn out.

According to the present aspect, moving the medium supporting member along the sloped portion brings the medium supporting member closer to the assisting support member. Since it is possible to move the medium supporting member along the sloped portion in one step without any need for movement in two steps in two directions that are orthogonal to each other, it is easier to move the medium supporting member to the drawn-out position.

The image forming apparatus according to a sixth aspect may be configured such that, in any one of the second to fifth aspects, the open-and-close member includes a holding portion that holds the guiding member drawn out on the open-and-close member.

According to the present aspect, since the guiding member drawn out is supported by the holding portion, it is possible to prevent the guiding member from returning to its housed position before drawing-out operation finishes.

The image forming apparatus according to a seventh aspect may be configured such that, in any one of the second to sixth aspects, the guiding member includes a protruding portion that protrudes toward the medium supporting member is formed on the guiding member, and a supported portion that is to be supported by the protruding portion in a state in which the medium supporting member is drawn out.

According to the present aspect, since the supported portion is supported by the protruding portion when the medium supporting member is in a drawn-out state, the medium supporting member is prevented from moving toward its housed position. This prevents the displacement of the medium supporting member in a drawn-out state with respect to the guiding member.

The image forming apparatus according to an eighth aspect may be configured such that, in the seventh aspect, the guiding member includes an elastic portion that has the protruding portion and is configured to deform elastically in a direction of going away from the medium supporting member.

According to the present aspect, in a state in which the medium supporting member is drawn out in relation to the guiding member, when the protruding portion is pushed by the supported portion in a direction of going away from the medium supporting member, the elastic portion deforms elastically in a direction of going away from the medium supporting member, thereby absorbing the pushing force applied from the supported portion. This prevents the deformation of the protruding portion from occurring when the medium supporting member is drawn out.

The image forming apparatus according to a ninth aspect may be configured such that, in the seventh or eighth aspects, the medium supporting member includes a contact portion that is configured to be in contact with the protruding portion when the medium supporting member is in a housed state.

According to the present aspect, since the contact of the contact portion with the protruding portion limits the movement of the medium supporting member with respect to the guiding member, it is possible to keep the medium supporting member in a housed state.

A tenth aspect is that, in any one of the first to ninth aspects, the image forming apparatus may further include: a first alignment member that is provided on the pushing-up member, is configured to move in a medium width direction intersecting with a transportation direction, in which the medium is transported, and is configured to align an edge in the medium width direction of the medium; a second alignment member that is provided on the assisting support member, is configured to move in the medium width direction, and is configured to align the edge in the medium width direction of the medium; and a linkage portion that is formed on the first alignment member and the second alignment member, the linkage portion being configured to cause one of the first alignment member and the second alignment member to move in linkage with movement of the other of the first alignment member and the second alignment member is formed on the first alignment member and the second alignment member. In the linkage portion, the second alignment member is rotatable in relation to the first alignment member in a direction in which the assisting support member rotates in relation to the apparatus body.

According to the present aspect, in a state in which the assisting support member constitutes a part of the transportation path, when either one of the first alignment member and the second alignment member is moved, the other of them is also moved by the linkage portion. This makes the alignment of the medium by the first alignment member and the second alignment member easier.

Moreover, in the linkage portion, the second alignment member is able to rotate freely in relation to the first alignment member, and, the free relative rotation makes it possible to prevent the first alignment member from obstructing the operation of the assisting support member when the assisting support member is rotated to be housed into the apparatus body.

An eleventh aspect is that, in any one of the first to tenth aspects, the image forming apparatus may further include: an urging member that is provided on the assisting support member and is configured to urge the assisting support member toward the open-and-close member.

According to the present aspect, when the open-and-close member is in a closed state, the open-and-close member resists the urging force of the urging member. When the open-and-close member is opened, the assisting support member is rotated due to the urging force of the urging member. Since opening the open-and-close member causes the rotation of the assisting support member automatically, the operation of rotating the assisting support member manually is unnecessary.

A twelfth aspect is that, in any one of the first to eleventh aspects, the image forming apparatus may further include: a pushing member that is provided on the apparatus body and is configured to push the open-and-close member in an opening direction, a region of contact of the open-and-close member and the pushing member being coated with a lubricant, wherein the open-and-close member has a restricting portion that restricts movement of the lubricant.

According to the present aspect, the lubricant reduces the force of friction caused by the contact of the open-and-close member and the pushing member. Moreover, since the restricting portion restricts the movement of the lubricant when the lubricant moves in a direction intersecting with a pushing direction due to the action of a pushing force applied by the pushing member, it is possible to prevent the lubricant from going to the outside of the region of contact of the open-and-close member and the pushing member.

Next, a printer 1 according to an exemplary embodiment of the present disclosure will now be explained with specific examples.

The printer 1 forms an image on paper P, which is an example of a medium described later.

In the description of the printer 1 below, directions will be mentioned with reference to X, Y, and X axes, which are orthogonal to one another. In each drawing, the X-axis direction is defined as a width direction of an apparatus. When a user stands facing the front of the apparatus, the direction toward the right is a −X direction, and the direction toward the left is a +X direction, as viewed from the user. The X-axis direction is defined also as a direction intersecting with the transportation direction of the paper P at a recording area where it faces a recording head 20 inside a printer body 2 described later. When the printer 1 is viewed in the +X direction, the clockwise direction is denoted as +R, and the counterclockwise direction is denoted as −R.

The Y-axis direction is defined as a depth direction of the apparatus. The direction from the rear toward the front of the apparatus is a +Y direction. The direction from the front toward the rear of the apparatus is a −Y direction. In the present embodiment, among lateral faces constituting the side enclosure of the printer 1, the face on which an operation unit 6 is provided is the front of the apparatus, and the opposite face is the rear of the apparatus. The paper P is transported in the +Y direction at the recording area described above inside the printer body 2 described later. The Z-axis direction is defined as a vertical direction. The direction going perpendicularly upward is a +Z direction. The direction going perpendicularly downward is a −Z direction. The arrow A indicates a direction in which the paper P is transported on a hopper 46 in a state before the hopper 46, which will be described later, is pushed up. This direction is denoted as +A. The direction that is opposite of the +A direction is a −A direction. As viewed in the X direction, the direction which is orthogonal to the A direction and in which the paper P is located with respect to the hopper 46 is a B direction.

Figure 2:
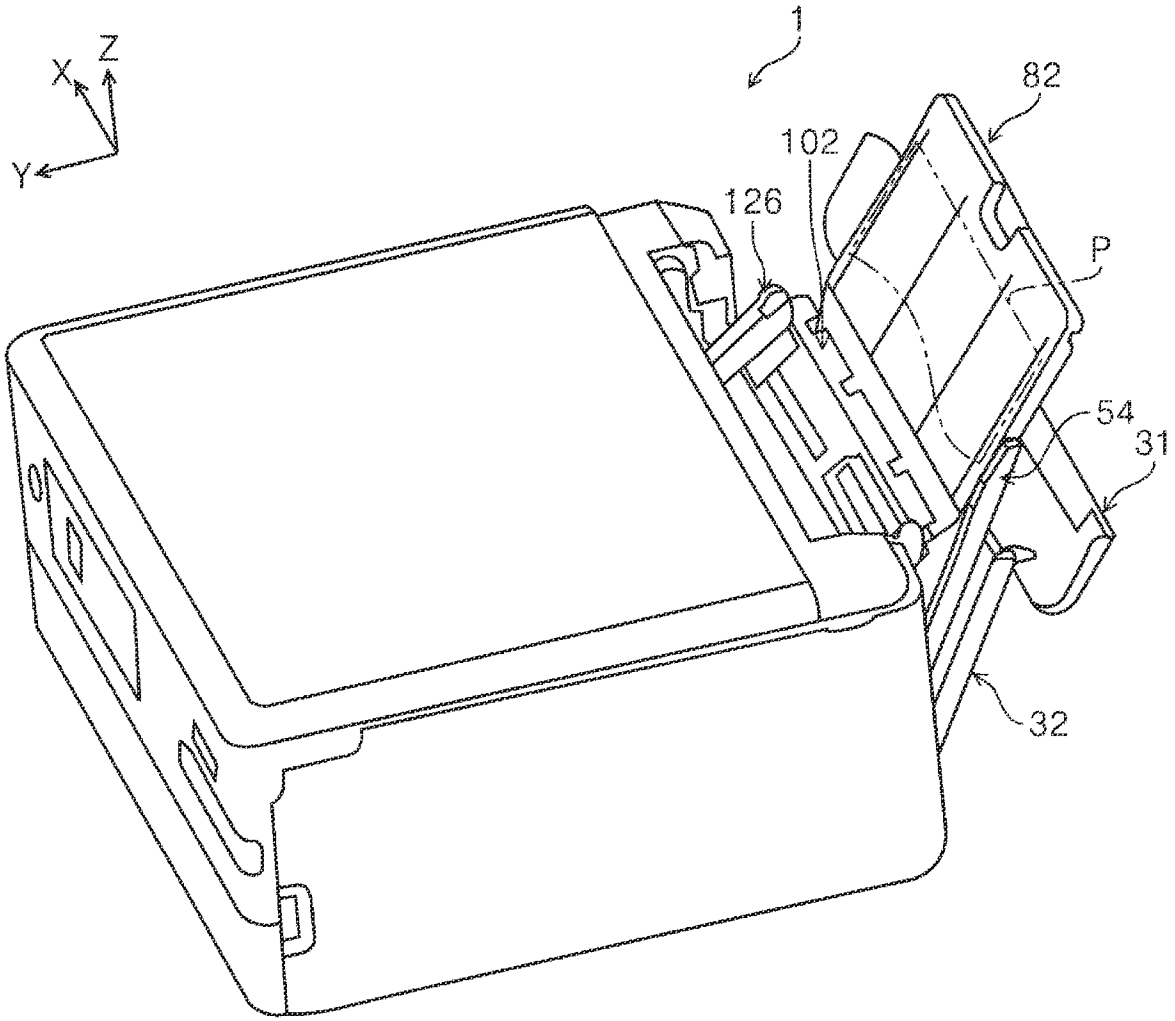
FIG. 2 is a perspective view of the printer when members including the open-and-close cover are opened, drawn out, and extended.
Figure 3:
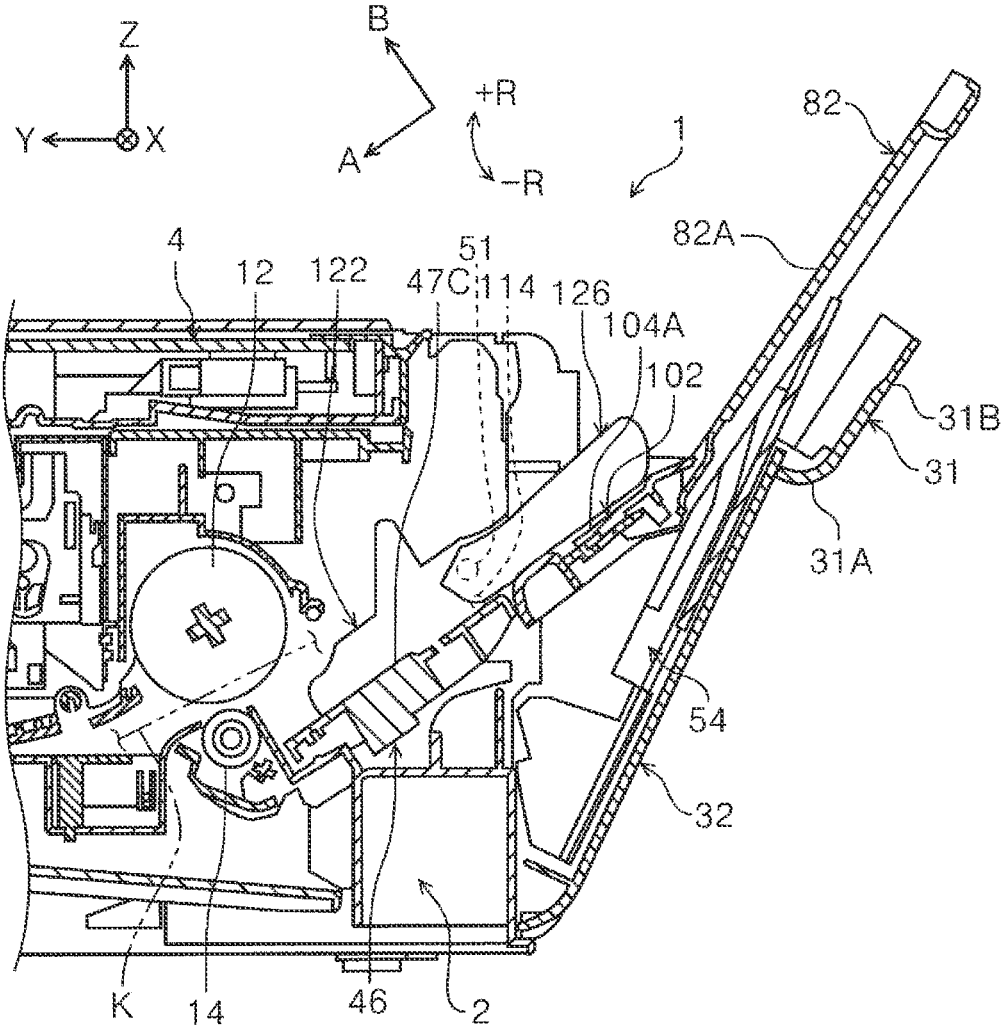
FIG. 3 is a partial cross-sectional side view of the printer when members including the open-and-close cover are opened, drawn out, and extended.

As illustrated in FIGS. 1, 2, and 3, the printer 1, which is an example of an image forming apparatus, is configured as an ink-jet printer. FIG. 1 illustrates a state in which each member of the printer 1 is housed. FIGS. 2 and 3 illustrate a state in which each member of the printer 1 such as a paper support 82 described later is tilted or drawn out.

As illustrated in FIG. 3, the printer 1 includes the printer body 2, an open-and-close cover 32, an upper cover 31, the hopper 46, the paper support 82, a support holder 102, a paper-supporting sub member 54, edge guides 122, and sub edge guides 126. The open-and-close cover 32, the upper cover 31, the hopper 46, the paper support 82, the support holder 102, the paper-supporting sub member 54, the edge guides 122, and the sub edge guides 126 are provided in the rear portion of the printer body 2. The printer 1 further includes a reading unit 4 and a non-illustrated control unit. The reading unit 4 is provided in the top portion of the printer body 2 and is configured to scan a document. The control unit includes a CPU (Central Processing Unit), a memory, and a storage that are not illustrated. The control unit controls the operation of each component of the printer 1.

As illustrated in FIG. 1, the printer body 2 is an example of an apparatus body and has a function of forming an image on the paper P. The printer body 2 has, on its front, the operation unit 6, which is used for performing various kinds of operation of the printer 1, and a front cover 8. The front cover 8 can be put into a closed state illustrated in FIG. 1 and an open state of opening the sheet exit portion of a transportation path K, along which the paper P is transported. The printer body 2 includes a feeding roller 12, a separating roller 14, a pair of transporting rollers 16, a pair of ejecting rollers 18, the recording head 20, and a carriage 22.

By rotating, the feeding roller 12 feeds the paper P downstream in the A direction. The separating roller 14, by forming a nip area between itself and the feeding roller 12, prevents the feeding of multiple sheets of the paper P from occurring. The pair of transporting rollers 16 is provided upstream of the recording head 20 in the Y direction and rotates to transport the paper P to the recording area. The pair of ejecting rollers 18 is provided downstream of the recording head 20 in the Y direction and rotates to let the paper P go out. The recording head 20 is an example of an image forming unit and is supported by the carriage 22. The carriage 22 receives motive power from a non-illustrated motor and reciprocates in the X-axis direction. The recording head 20 performs recording on the paper P by ejecting ink droplets onto the paper P while being moved in the X-axis direction due to the movement of the carriage 22. That is, the recording head 20 forms an image on the paper P that is transported.

Figure 5B:
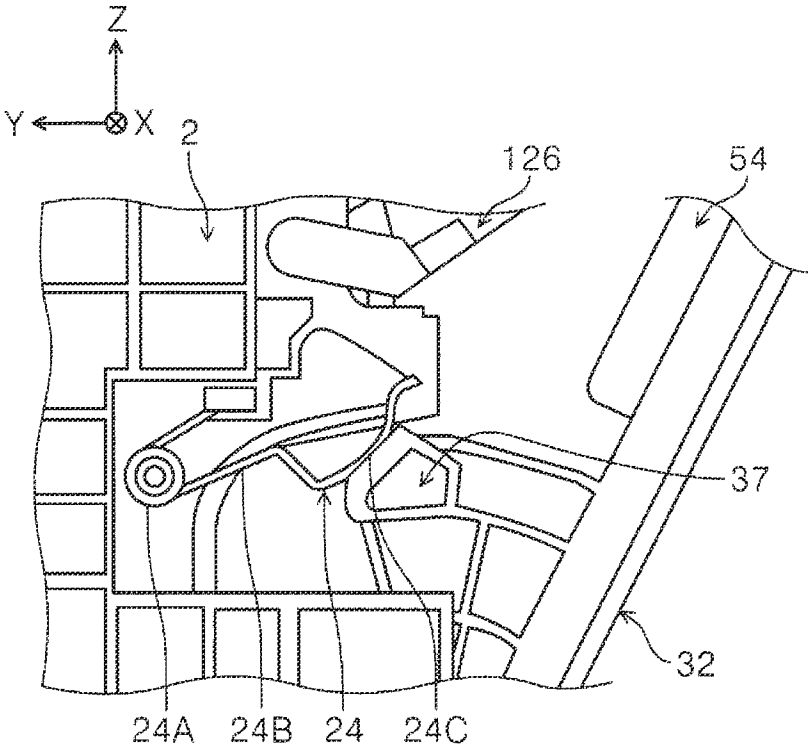
FIG. 5B is a side view illustrating a state in which the first spring pushes the overhang portion of the open-and-close cover.
Figure 5A:
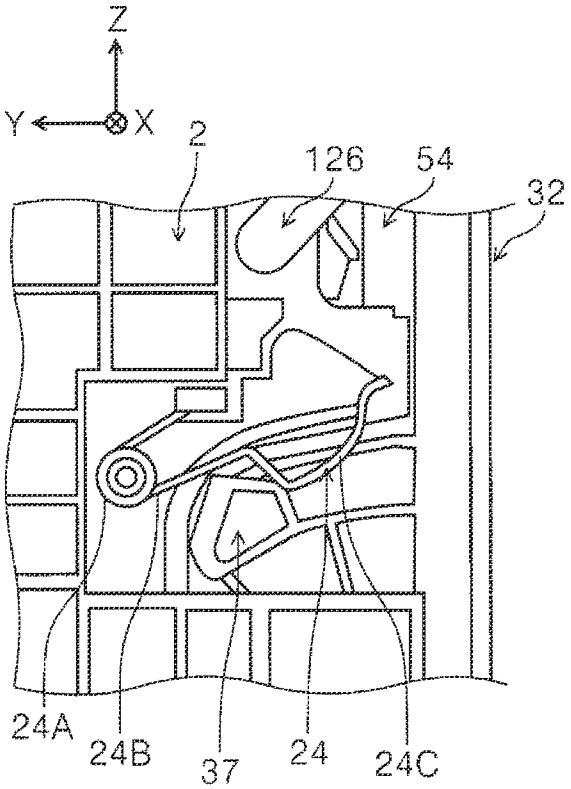
FIG. 5A is a side view illustrating a state in which a first spring keeps the overhang portion of the open-and-close cover in position.

As illustrated in FIGS. 5A and 5B, a first spring 24 is provided on an end portion that is the −Y directional end and is the −X directional end of the printer body 2. The first spring 24 is an example of a pushing member that pushes the open-and-close cover 32, which will be described later, in an opening direction. Specifically, the first spring 24 is a torsion spring and includes a mounted portion 24A, which is mounted on the printer body 2, a straight portion 24B, which extends in the −Y direction from the mounted portion 24A, and a bent portion 24C, which is bent from the straight portion 24B in such a way as to have a −Z directional convex shape. The bent portion 24C is hooked on to an overhang portion 37, which will be described later, to hold the overhang portion 37 when the open-and-close cover 32 is in a closed state. This engagement keeps the open-and-close cover 32 closed. When the open-and-close cover 32 is in an open state, the bent portion 24C, by being in contact with the overhang portion 37, applies a pushing force that acts in an opening direction to the open-and-close cover 32.

With reference to FIG. 3, the layout of the members will now be described schematically.

The open-and-close cover 32 is provided on the printer body 2 in such a way as to be able to open and close the rear portion and the inside of the printer body 2. In other words, the open-and-close cover 32 is provided on the printer body 2 in such a way as to be able to be opened and closed for switching between an open state and a closed state. When closed, the open-and-close cover 32, together with the printer body 2, covers the hopper 46. When opened, the open-and-close cover 32 exposes the hopper 46 to the outside of the printer body 2. The upper cover 31 is coupled rotatably to the +Z directional end of the open-and-close cover 32. The paper-supporting sub member 54 is provided in such a way as to be able to move in relation to the open-and-close cover 32. The paper support 82 is provided in such a way as to be able to move in relation to the paper-supporting sub member 54. The hopper 46 is provided upstream of the feeding roller 12 in the +A direction. The hopper 46 pushes the paper P up toward the feeding roller 12. The support holder 102 is provided between the paper support 82 and the hopper 46 in the A direction. The support holder 102, in a tilted state, supports the paper P. The edge guides 122 are provided on the hopper 46 and are configured to align both of the X directional edges of the paper P. The sub edge guides 126 are provided on the support holder 102 and are configured to align both of the X directional edges of the paper P.

The structure of each member will now be explained with specific examples. Regarding the layout and directions of each member, the description below will be given based on the housed state illustrated in FIG. 1.

Figure 4:
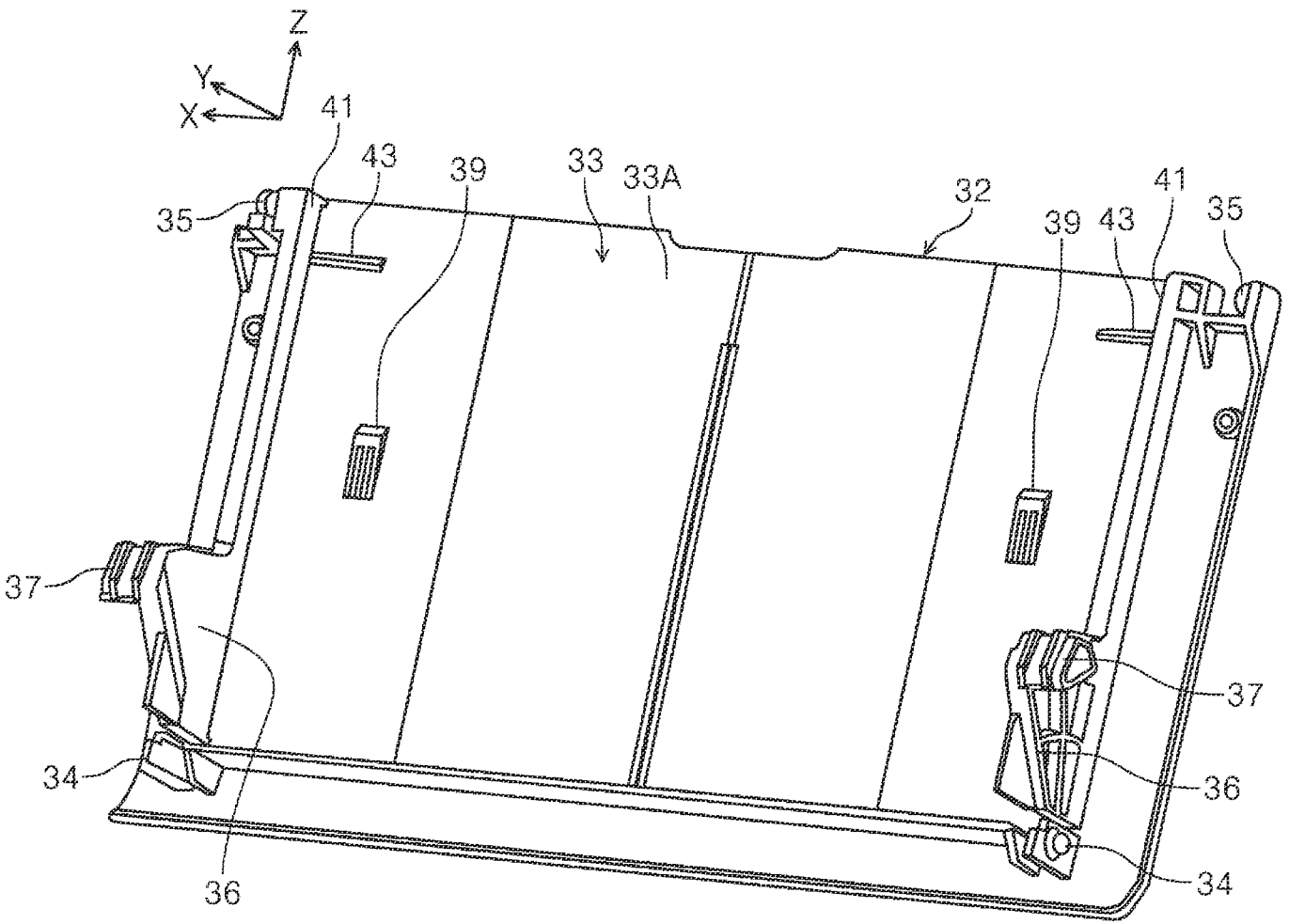
FIG. 4 is a perspective view of the open-and-close cover.

As illustrated in FIG. 4, the open-and-close cover 32 includes a plate portion 33, pivots 34, a coupled portion 35, an extending portion 36, the overhang portion 37, a convex portion 39, a groove portion 41, and restriction ribs 43. The plate portion 33 has a predetermined thickness in the Y-axis direction. When the open-and-close cover 32 is in a housing state, the plate portion 33 constitutes a part of the sidewalls of the printer 1. The +Y directional surface of the plate portion 33 will be hereinafter referred to as a front surface 33A. The pivot 34 has a columnar shape having a non-illustrated center axis extending in the X-axis direction. At a −Z directional end region with respect to the center of the plate portion 33 in the Z direction, the pivots 34 are located with a space from each other in the X direction. The pivots 34 are coupled to non-illustrated −Z directional ends of the rear of the printer body 2 in such a way as to be able to rotate around their center axis. With this structure, the open-and-close cover 32 is able to open and close the rear portion of the printer body 2 and the transportation path K (FIG. 1) located inside the printer body 2.

The coupled portion 35 is formed on +Z directional ends with respect to the center of the plate portion 33 in the Z-axis direction. The extending portion 36 extends in the +Y direction from a region located on the −Z directional side with respect to the center of the plate portion 33 in the Z-axis direction and on the +Z directional side with respect to the pivot 34. Two extensions, named collectively as the extending portion 36, are formed with a space from each other in the X-axis direction. The convex portion 39 is an example of a holding portion. One convex and the other convex, as the convex portion 39, are formed at the Z directional center region of the plate portion 33 with a space from each other in the X-axis direction. The convex portion 39 protrudes in the +Y direction from the front surface 33A. When viewed in the X-axis direction, the convex portion 39 has a trapezoidal shape. The angle of inclination of the +Z-side slope of the convex portion 39 is, for example, greater than the angle of inclination of the −Z-side slope of the convex portion 39. The convex portion 39 holds the paper-supporting sub member 54 (FIG. 1) when it is drawn out. The groove portion 41 protrudes in the +Y direction at a +X directional region and a −X directional region of the plate portion 33 and extends straight along the Z axis. The groove portion 41 is open toward the X directional center of the plate portion 33. At respective regions located on the +Z directional side with respect to the center of the plate portion 33 in the Z-axis direction, the restriction ribs 43 are provided with a space from each other in the X-axis direction and protrude in the +Y direction. Each of the restriction ribs 43 extends in the X-axis direction.

Figure 6:
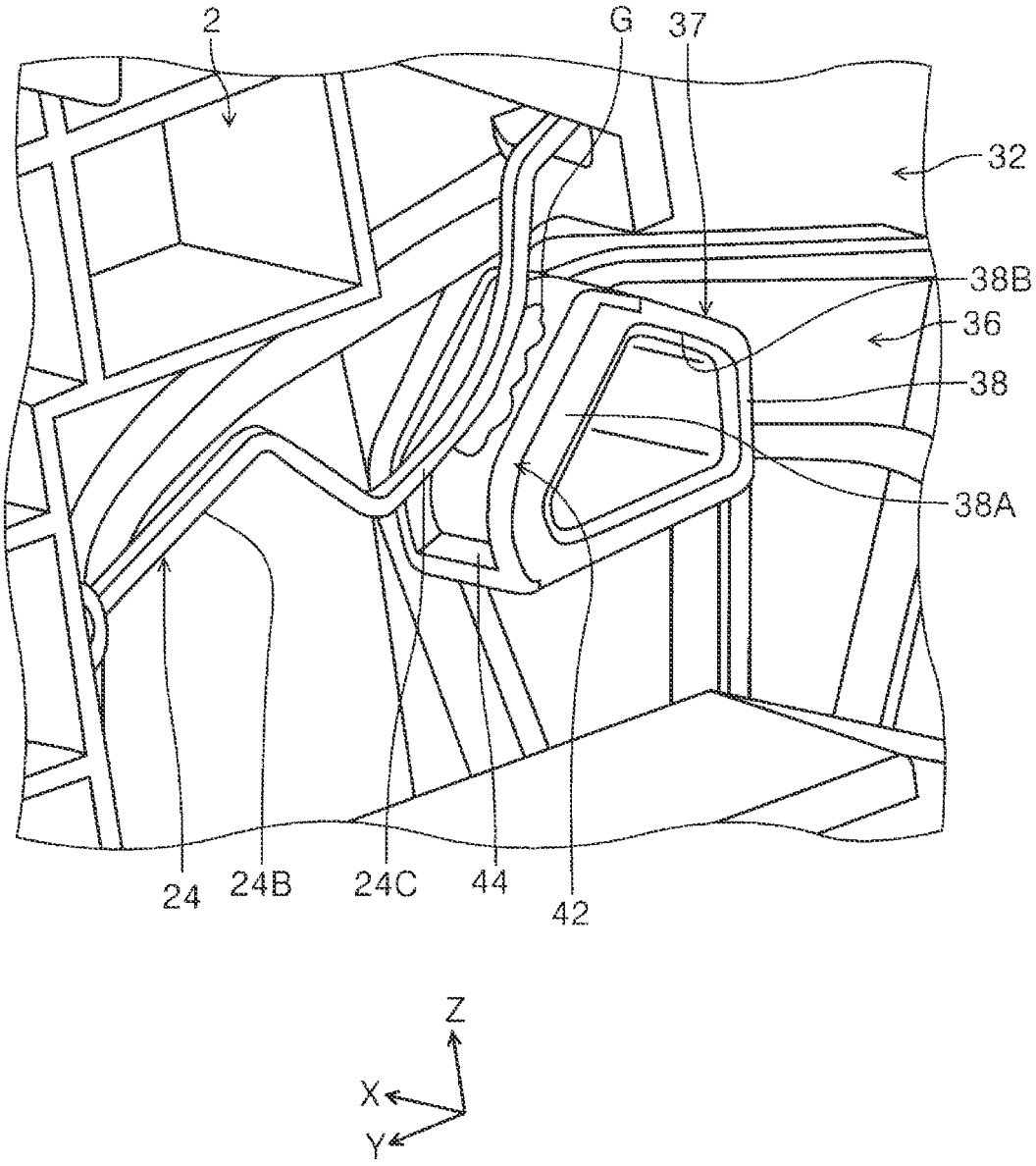
FIG. 6 is a perspective view illustrating a state of contact of the first spring with the contacted portion of the open-and-close cover.

As illustrated in FIG. 6, the overhang portion 37 sticks outward in the X-axis direction from the +Y directional end of the extending portion 36. The overhang portion 37 has a polygonal columnar shape having a non-illustrated center axis extending in the X direction. The overhang portion 37 has a surrounding wall 38. The surrounding wall 38 has a front portion 38A and a rear portion 38B. When the open-and-close cover 32 is in a closed state, the front portion 38A is located on the +Y directional side with respect to the center of the overhang portion 37, and the rear portion 38B is located on the −Y directional side with respect to the center of the overhang portion 37. When the open-and-close cover 32 is in an open state, the front portion 38A receives a pushing force that acts in a direction of opening the open-and-close cover 32 by being in contact with the bent portion 24C. When the open-and-close cover 32 is in a closed state, the rear portion 38B restricts movement in the opening direction by being in contact with the bent portion 24C. The front portion 38A is an example of a portion where the open-and-close cover 32 comes into contact with the first spring 24. A restricting portion 42 is formed on the front portion 38A.

The restricting portion 42 is made up of edge walls 44 rising from both of the X directional edges of the front portion 38A and from the −Z directional edge of the front portion 38A. In other words, the edge walls 44 enclose the area of contact of the first spring 24 and the front portion 38A. The length corresponding to the interval between the edge walls 44 in the X-axis direction is greater than the length corresponding to the thickness of the elongated body of the first spring 24. The surface of the front portion 38A inside the edge walls 44 is coated with a lubricant G. The lubricant G is, for example, semisolid grease. The edge wall 44 has a sufficient height for preventing the lubricant G from surmounting the edge wall 44 when the lubricant G flows in the X-axis direction. With this structure, the restricting portion 42 is able to restrict the movement of the lubricant G.

As illustrated in FIG. 3, the upper cover 31 is a member that has a cross-sectional shape made up of a curved portion 31A and a flat portion 31B when viewed in the X direction. The upper cover 31 extends in the X direction. Non-illustrated pivots having a center axis extending in the X-axis direction are formed on the curved portion 31A. The pivots are connected to the coupled portion 35 (FIG. 4). With this structure, the upper cover 31 is able to rotate in relation to the open-and-close cover 32. The upper cover 31 is supported by the open-and-close cover 32. The upper cover 31 moves together with the open-and-close cover 32 when the open-and-close cover 32 is opened and closed. The upper cover 31, when opened, is retracted on a relatively −Y directional side in comparison with the position of the open-and-close cover 32. The upper cover 31, when closed, closes the rear top of the printer body 2.

Figure 7:
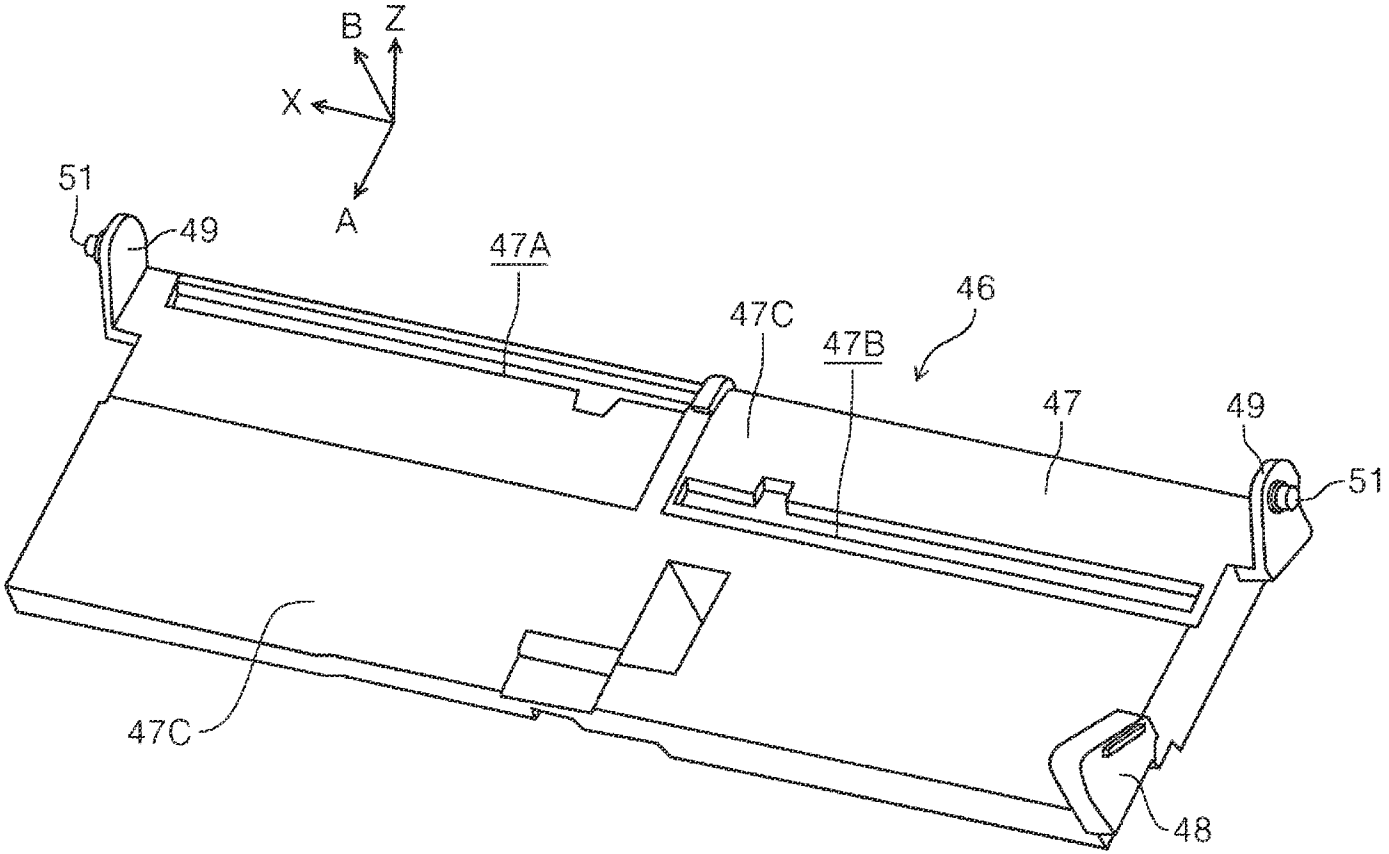
FIG. 7 is a perspective view of a hopper, showing its front surface.

The hopper 46 is an example of a pushing-up member. As illustrated in FIG. 7, the hopper 46 includes a hopper plate 47, a cam follower portion 48, a rising plate portion 49, and a pivotal projection portion 51. In the description of the hopper 46 below, a state in which the thickness direction of the hopper plate 47 is the B direction is assumed. An external force that acts in a pushing-up direction is applied to the hopper 46 by a non-illustrated spring. The hopper plate 47 extends in the X direction. Guide slits 47A and 47B, each of which extends in the X-axis direction, are formed at respective regions located on the −A directional side with respect to the center of the hopper plate 47 in the A-axis direction. The guide slit 47A is located on the +X directional side with respect to the center of the hopper plate 47 in the X direction. The guide slit 47B is located on the −X directional side with respect to the center of the hopper plate 47 in the X direction. The guide slit 47B is located at a relatively downstream position in the +A direction in comparison with the guide slit 47A. The guide slits 47A and 47B guide the edge guides 122 (FIG. 3), which will be described later, in the X direction. In other words, the edge guides 122 are provided on the hopper 46. The +B directional surface of the hopper 46 will be hereinafter referred to as a front surface 47C. The front surface 47C is a surface on which a part of the paper P is placed. In other words, the front surface 47C is an example of a third supporting surface for supporting the paper P.

The cam follower portion 48 rises from the +A directional end region of the −X directional end of the hopper 46 upright in the B direction. The rising plate portion 49 rises from the −A directional end region of each of the two X directional ends of the hopper plate 47 upright in the B direction. The pivotal projection 51 is a portion that protrudes outward in the X-axis direction from each of the rising plates 49. The pivotal projection 51 has a cylindrical shape having a non-illustrated center axis extending in the X-axis direction. The pivotal projections 51 are supported rotatably by walls 113 (FIG. 15) that constitute a part of the printer body 2 (FIG. 3). When the hopper 46 having the structure described above is rotated in one direction or the other direction around the center axis of the pivotal projections 51, the +A directional end of the hopper 46 is raised in the +B direction or lowered in the −B direction.

As illustrated in FIG. 3, the hopper 46 is provided rotatably on the printer body 2. The hopper 46, with sheets of the paper P supported thereon, pushes the paper P up by receiving a force from a non-illustrated spring. The hopper 46 is pushed down when the cam follower portion 48 is pushed down by a non-illustrated cam against the pushing-up force of the spring. As explained above, the hopper 46 pushes up the +A directional end of sheets of the paper P placed thereon toward the feeding roller 12 in the +B direction.

Figure 8:
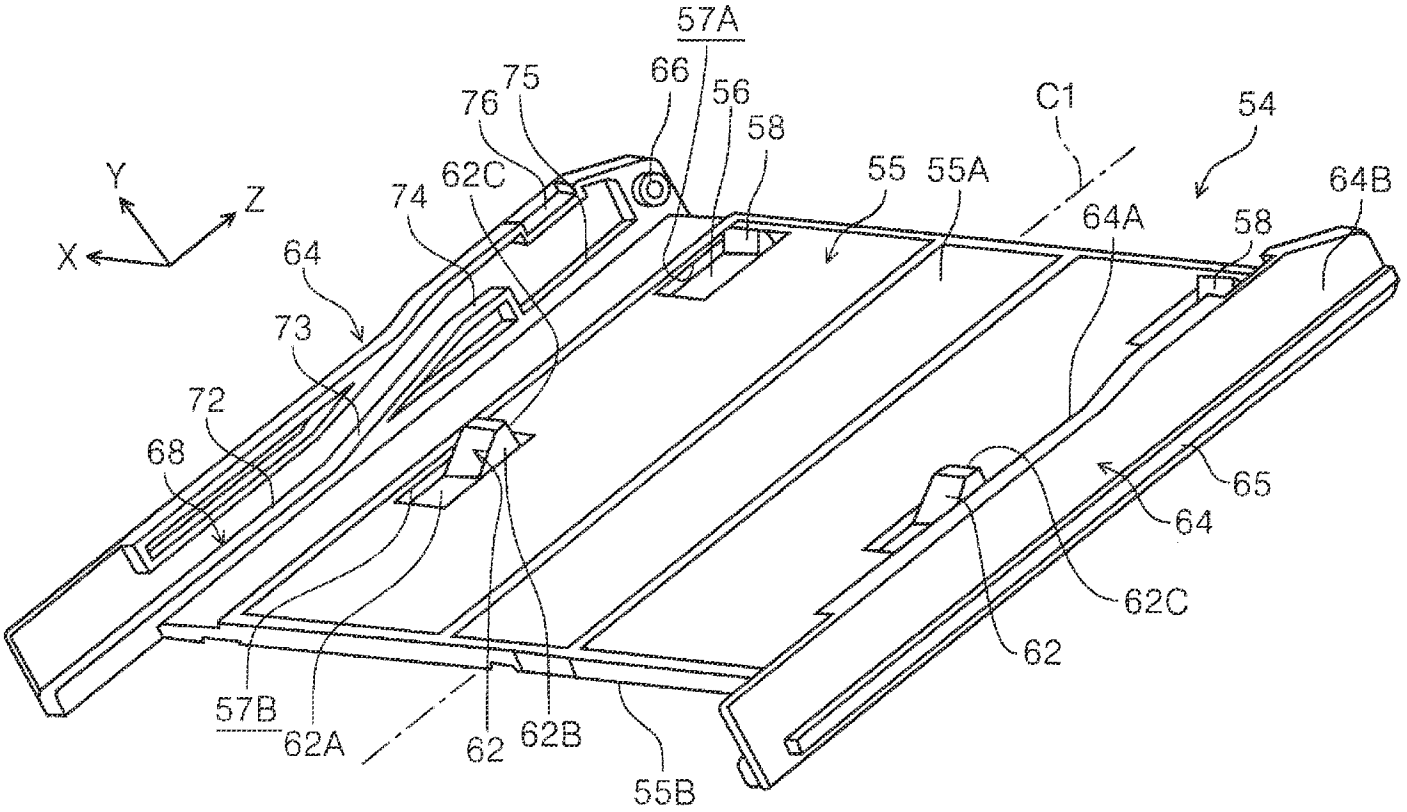
FIG. 8 is a perspective view of a paper-supporting sub member, showing its front surface.

The paper-supporting sub member 54 illustrated in FIG. 8 is an example of a guiding member. When the paper support 82 (FIG. 3) is drawn out, the paper-supporting sub member 54 guides the paper support 82 toward the support holder 102 (FIG. 3). Specifically, the paper-supporting sub member 54 guides a Z directional lower end portion of the front surface 82A (FIG. 10) of the paper support 82 described later to a position that is continuous from a Z directional upper end portion of the front surface 104A (FIG. 14) of the support holder 102 described later.

The paper-supporting sub member 54 includes a plate portion 55, an elastic portion 56, a protruding portion 58, a projection portion 62, a sidewall portion 64, first bosses 66, and guide rails 68. The paper-supporting sub member 54 is provided on the open-and-close cover 32 (FIG. 3). The paper-supporting sub member 54 is movable in a direction in which the paper support 82 described later is drawn out. Regarding the layout of each component of the paper-supporting sub member 54, the description below will be given while assuming a state in which the paper-supporting sub member 54 is upright in the Z-axis direction. The paper-supporting sub member 54 has, for example, a line-symmetric structure with respect to a center line C1 that goes in the Z direction through the X directional center of the paper-supporting sub member 54. Therefore, its structure on the +X directional side with respect to the center line C1 will be described below, and an explanation of its structure on the −X directional side will be omitted. Its structure on the −X directional side will be illustrated and explained only for a rail portion 65 described later.

The plate portion 55 has a predetermined thickness in the Y direction. The plate portion 55 has a rectangular shape whose size in the X direction is larger than size in the Z direction. The size of the plate portion 55 in the Z direction is smaller than the size of the open-and-close cover 32 in the Z direction. The +Y directional surface of the plate portion 55 will be hereinafter referred to as a front surface 55A. The −Y directional surface of the plate portion 55 will be hereinafter referred to as a back 55B. Through holes 57A and 57B going through the plate portion 55 in the Y direction are formed in the plate portion 55. The through holes 57A and 57B are spaced from each other in the Z direction. The through hole 57A is located at a position on the +Z directional side with respect to the through hole 57B. When viewed in the Y direction, each of the through holes 57A and 57B is formed in such a way as to have a U-shaped opening in an orientation toward the −Z directional end of the plate portion 55.

The elastic portion 56 is formed in the plate portion 55. From a region that is adjacent in the X-axis direction to the two −Z-side ends of the through hole 57A, the elastic portion 56 extends in the +Z direction without being in contact with the through hole 57A. The elastic portion 56 is a plate-like portion having a predetermined thickness in the Y direction. The elastic portion 56 has a rectangular shape whose size in the Z-axis direction is larger than size in the X-axis direction. Since the elastic portion 56 is partially separated from the plate portion 55 due to the presence of the through hole 57A, the elastic portion 56 is able to elastically deform as a leaf spring. In other words, the elastic portion 56 is able to elastically deform in the Y-axis direction, with its −Z directional end behaving as a base end, and with its +Z directional end behaving as a free end. The elastic portion 56 is molded integrally with the protruding portion 58. The elastic portion 56 supports the protruding portion 58.

The protruding portion 58 is formed on the +Z directional end of the elastic portion 56. The protruding portion 58 protrudes beyond the front surface 55A in the +Y direction. In other words, the protruding portion 58 protrudes toward the paper support 82 described later. The protruding portion 58 is able to change its position in the Y-axis direction as a result of the elastic deformation of the elastic portion 56 in the Y-axis direction. The protruding portion 58, by changing its position in the Y-axis direction, enables the paper support 82 to move in the Z-axis direction and is able to support the paper support 82 at a predetermined position.

The projection portion 62 is formed in the plate portion 55. The projection portion 62 has a flat portion 62A and a projection 62B. From a region that is adjacent in the X-axis direction to the two −Z-side ends of the through hole 57B, the flat portion 62A extends in the +Z direction without being in contact with the through hole 57B. The flat portion 62A is a portion that is able to elastically deform in the Y-axis direction. The projection 62B is formed on the +Z directional end of the flat portion 62A. The projection 62B protrudes from the flat portion 62A in the +Y direction. A flat surface 62C that is along the X-Y plane, for example, is formed as the +Z directional end surface of the projection 62B. The flat surface 62C supports a part of the paper support 82 in the Z direction.

The sidewall portion 64 rises upright in the +Y direction from the +X directional end of the plate portion 55. The sidewall portion 64 extends in the Z direction. The sidewall portion 64 has a predetermined thickness in the X direction. The +Z directional end of the sidewall portion 64 is located beyond the +Z directional end of the plate portion 55 in the +Z direction. The −Z directional end of the sidewall portion 64 is located beyond the −Z directional end of the plate portion 55 in the −Z direction. A portion on the +Z directional side with respect to the center of the sidewall portion 64 in the Z-axis direction has a larger size in the Y-axis direction than a portion on the −Z directional side thereof. The sidewall portion 64 has a side surface 64A, which is oriented toward the plate portion 55, and a side surface 64B, which is the opposite side surface. The rail portion 65 protruding in the X direction and extending in the Z direction is formed on the side surface 64B. The rail portion 65 is fitted in the groove portion 41 (FIG. 4) described earlier. This structure enables relative movement the paper-supporting sub member 54 in the Z-axis direction in relation to the open-and-close cover 32.

On the +Z directional end of the sidewall portion 64, the first boss 66, which is an example of a pivotal portion, protrudes from the sidewall portion 64 toward the center line C1. The first boss 66 has a cylindrical shape having a non-illustrated center axis extending in the X-axis direction. The first boss 66 supports the paper support 82 (FIG. 3), which will be described later and is being moved toward a drawn-out position, rotatably around the center axis of the first boss 66. The drawn-out position of the paper support 82 means the position where the paper support 82 is located at a point in time when an operation of drawing the paper support 82 out finishes.

The guide rail 68, which is an example of a guiding groove, guides the paper support 82 to the drawn-out position. Specifically, the guide rail 68 is formed in the sidewall portion 64 as a groove that is recessed in a direction of going away from the center line C1. The guide rail 68 extends in the Z direction. The guide rail 68 has, for example, a first guide portion 72, a second guide portion 73, a third guide portion 74, and a widening portion 75 in this order as viewed from the −Z directional side toward the +Z directional side. These portions of the guide rail 68 are explained below based on understanding that the paper support 82 (FIG. 3) is drawn out in the Z-axis direction in the description below, the guide rail 68 is viewed from the −X directional side.

The first guide portion 72 extends linearly in the Z-axis direction. The −Z directional end of the first guide portion 72 is open in the −Z direction and the +Y direction. The second guide portion 73, which is an example of a sloped portion, extends from the +Z directional end of the first guide portion 72 in an intersecting direction that intersects with the Z-axis direction. For example, the intersecting direction is a direction in which the +Z directional end of the second guide portion 73 is located relatively on the +Y directional side in comparison with the −Z directional end of the second guide portion 73. The second guide portion 73 has a function of causing the paper support 82 to go away from the plate portion 55 in the +Y direction as it goes toward the +Z directional side. In other words, the second guide portion 73 has a function of causing the −Z directional end of the paper support 82 to approach the support holder 102 (FIG. 3).

The third guide portion 74 extends in the +Z direction from the +Z directional end of the second guide portion 73. The length of the third guide portion 74 in the Z-axis direction is less than the length of the first guide portion 72 in the Z-axis direction. The widening portion 75 is a portion that extends in the +Z direction from the +Z directional end of the third guide portion 74. The width of the widening portion 75 in the Y-axis direction is greater than the width of the third guide portion 74 in the Y-axis direction. A recessed portion 76, which is recessed in the −Y direction, is formed in the +Y directional wall of the widening portion 75. The first boss 66 is located at a position that is on the +Z directional side with respect to the widening portion 75.

Figure 9:
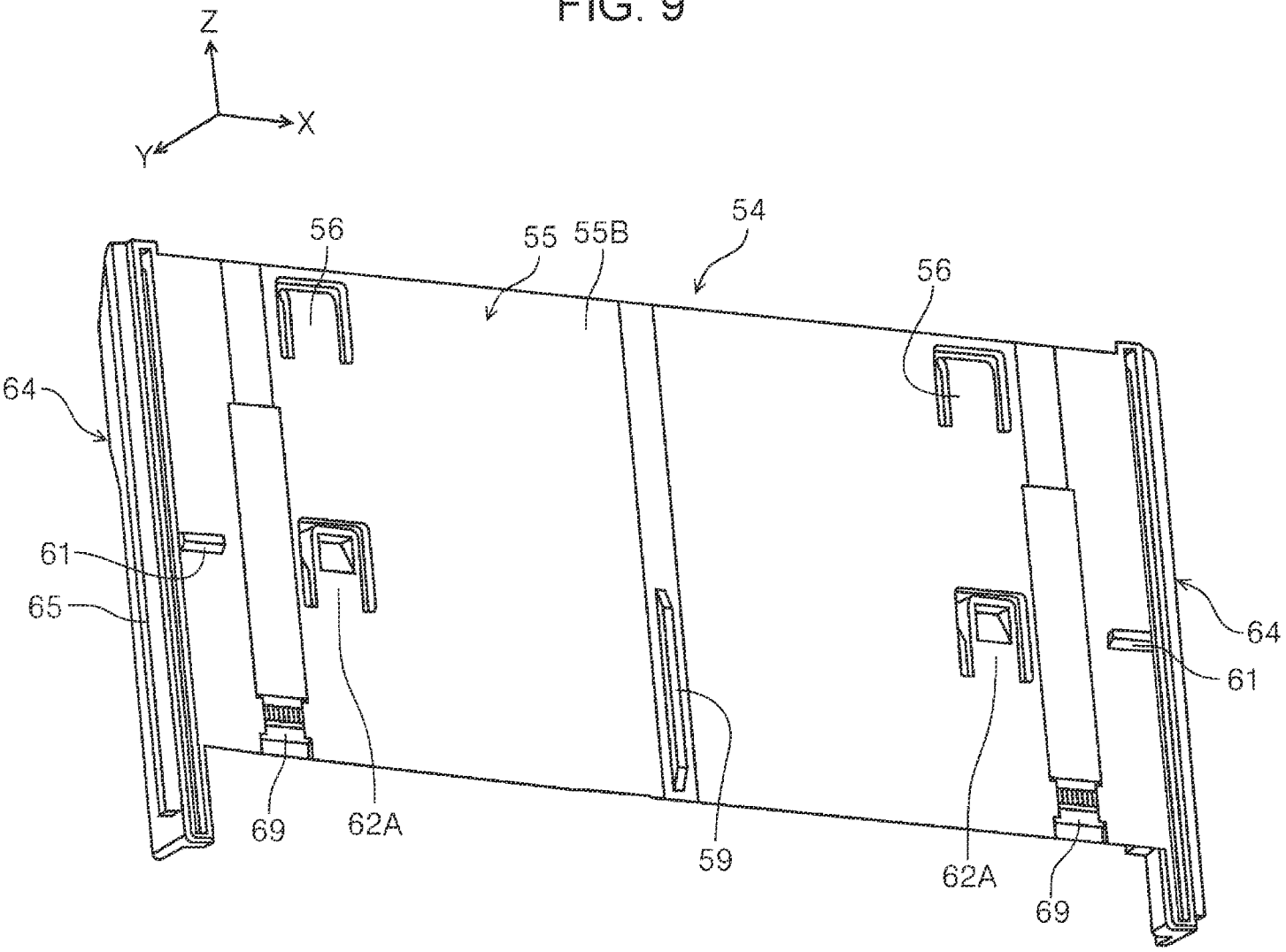
FIG. 9 is a back perspective view of the paper-supporting sub member.

As illustrated in FIG. 9, a fin portion 59, which protrudes in the −Y direction, is formed on the back 55B of the plate portion 55 at a region located on the center in the X-axis direction on the −Z directional side with respect to the center in the Z-axis direction. By being in contact with the open-and-close cover 32 (FIG. 3), the fin portion 59 supports the plate portion 55. A bulged portion 69 is formed on the back 55B at a region located inside in the X-axis direction in comparison with the sidewall portion 64 and outside in the X-axis direction in comparison with the fin portion 59. The bulged portion 69 is bulged from the back 55B in the −Y direction. When viewed in the X direction, the bulged portion 69 has a trapezoidal shape. An engagement portion 61 is formed on the back 55B. The engagement portion 61 protrudes in the −Y direction from each of the two X directional ends of the back 55B. By coming into engagement with the restriction rib 43 (FIG. 4) when the paper-supporting sub member 54 is drawn out, the engagement portion 61 prevents the paper-supporting sub member 54 from being drawn out more than necessary.

Figure 10:
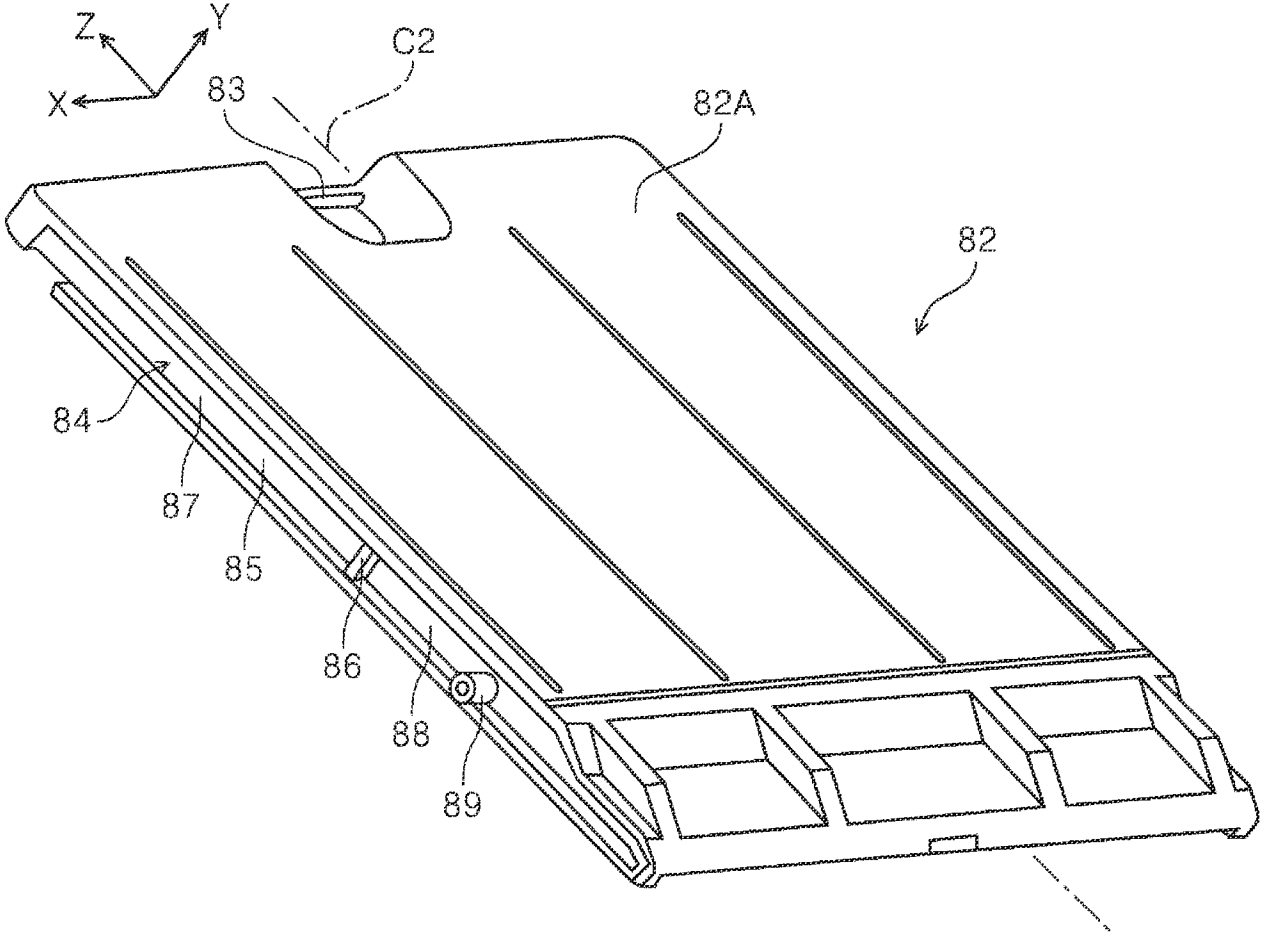
FIG. 10 is a perspective view of a paper support, showing its front surface.

As illustrated in FIG. 10, the paper support 82, which is an example of a medium supporting member, is formed as a plate-type member that has its thickness in the Y-axis direction. The paper support 82 is able to be housed inside, and drawn away from, the open-and-close cover 32 (FIG. 3). By being drawn out when the open-and-close cover 32 is in an open state, the paper support 82 becomes able to support the paper P. Specifically, the paper support 82 is provided in such a way as to be able to be housed inside, and drawn away from, the open-and-close cover 32 indirectly via the paper-supporting sub member 54 (FIG. 8). Regarding the layout of each component of the paper support 82, the description below will be given while assuming a state in which the paper support 82 is upright in the Z-axis direction. The paper support 82 has, for example, a horizontally symmetric structure with respect to a center line C2 that goes in the Z-axis direction through the X directional center of the paper support 82. Therefore, its structure on the +X directional side with respect to the center line C2 will be described below, and an explanation of its structure on the −X directional side will be omitted.

Figure 11:
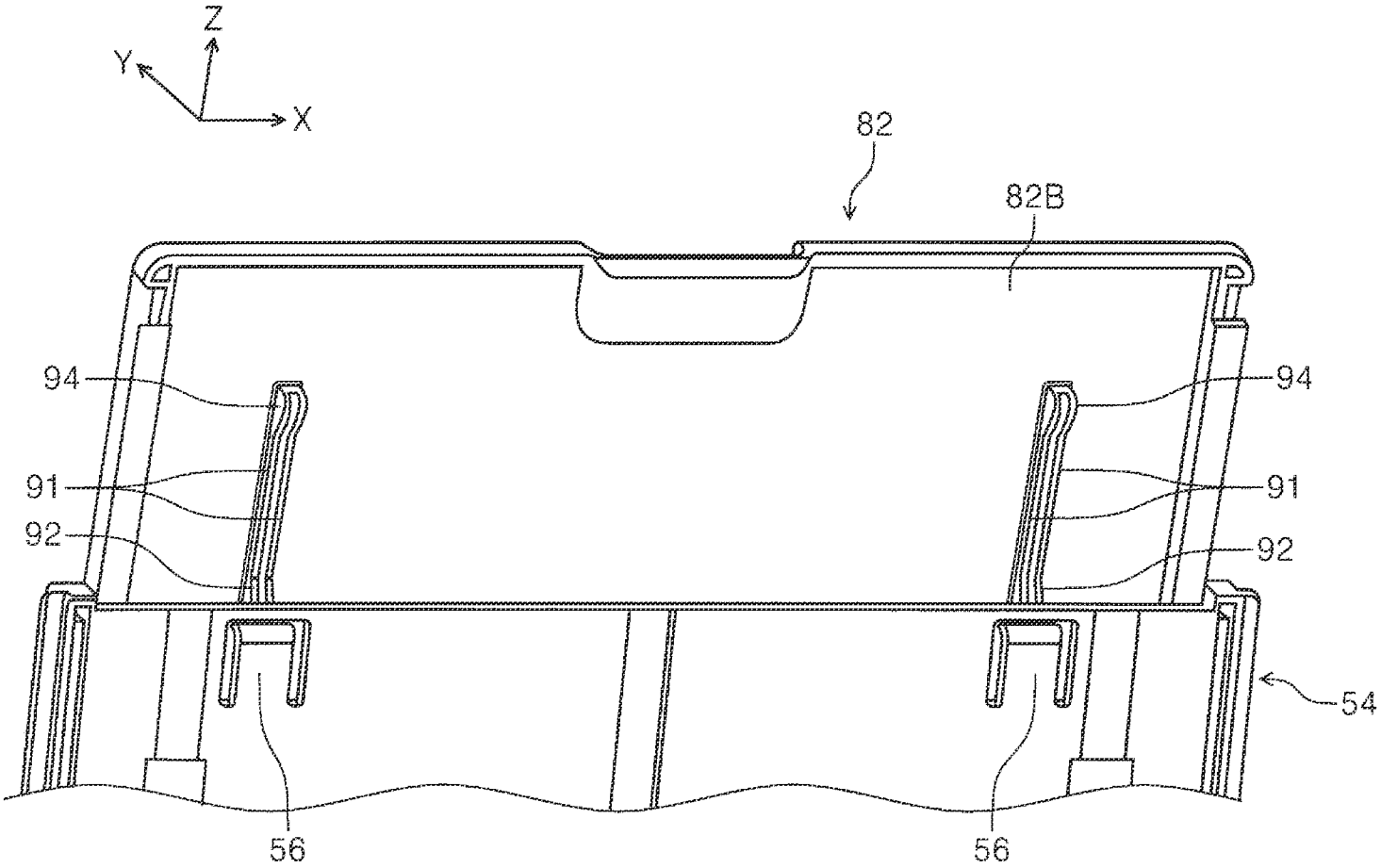
FIG. 11 is a back perspective view of the paper support and the paper-supporting sub member.

The +Y directional surface of the paper support 82 will be hereinafter referred to as a front surface 82A. The −Y directional surface of the paper support 82 will be hereinafter referred to as a back 82B (FIG. 11). The front surface 82A is a surface on which a part of the paper P is placed. In other words, the front surface 82A is an example of a first supporting surface for supporting the paper P. A grip portion 83 is formed on the +Z directional end of the paper support 82. The −Z directional end of the paper support 82 is recessed in the −Y direction. A concave portion 84 recessed in the −X direction is formed in the +X directional end of the paper support 82. The concave portion 84 has a cross-sectional shape of a letter U when viewed in the Z-axis direction. The concave portion 84 extends in the Z-axis direction. A side surface 85, which is along the Y-Z plane, is formed at a region corresponding to the bottom of the concave portion 84. A partition wall 86 is formed substantially at the center of the concave portion 84 in the Z direction. The partition wall 86 rises from the side surface 85 in the +X direction. The partition wall 86 partitions the concave portion 84 into a first concave portion 87 and a second concave portion 88.

The first concave portion 87 is located on the +Z directional side with respect to the partition wall 86. The first boss 66 (FIG. 8) is inserted in the first concave portion 87. The first concave portion 87 guides the first boss 66 in the Z direction. The second concave portion 88 is located on the −Z directional side with respect to the partition wall 86. A second boss 89 is formed on the side surface 85 of the second concave portion 88 substantially at the center thereof in the Z direction. The second boss 89 protrudes from the side surface 85 in the +X direction in such a way as to have a height greater than the height of the partition wall 86. The second boss 89 has a cylindrical shape having a center axis extending in the X-axis direction. The second boss 89 is inserted on the guide rail 68 (FIG. 8) and is guided along the guide rail 68.

As illustrated in FIG. 11, two ribs 91 that are substantially parallel to each other are formed on the back 82B. The rib 91 extends in the Z-axis direction. A supported portion 92 is formed on the −Z directional end of the rib 91. A contact portion 94 is formed on the +Z directional end of the rib 91.

Figure 12B:
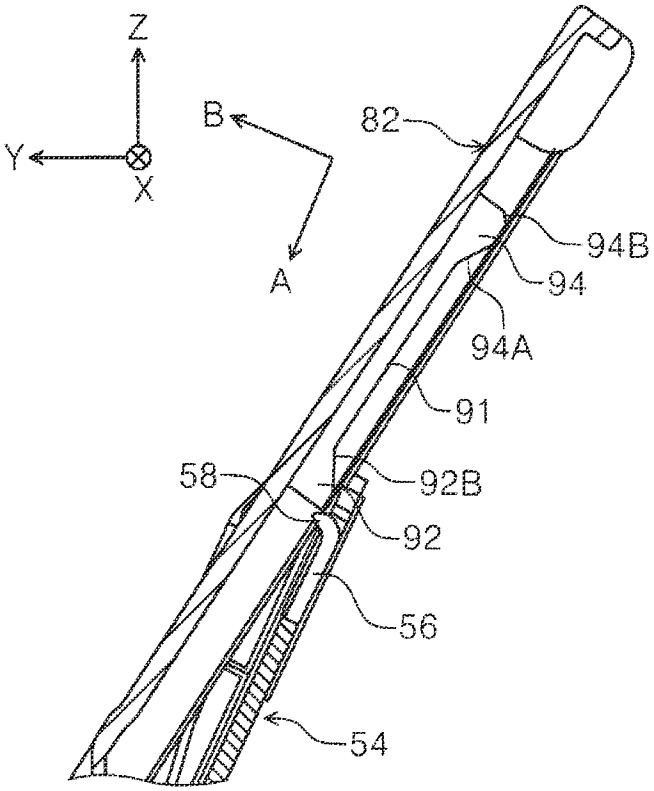
FIG. 12B is a cross-sectional side view of the paper support and the paper-supporting sub member in a drawn-out, extended state.
Figure 12A:
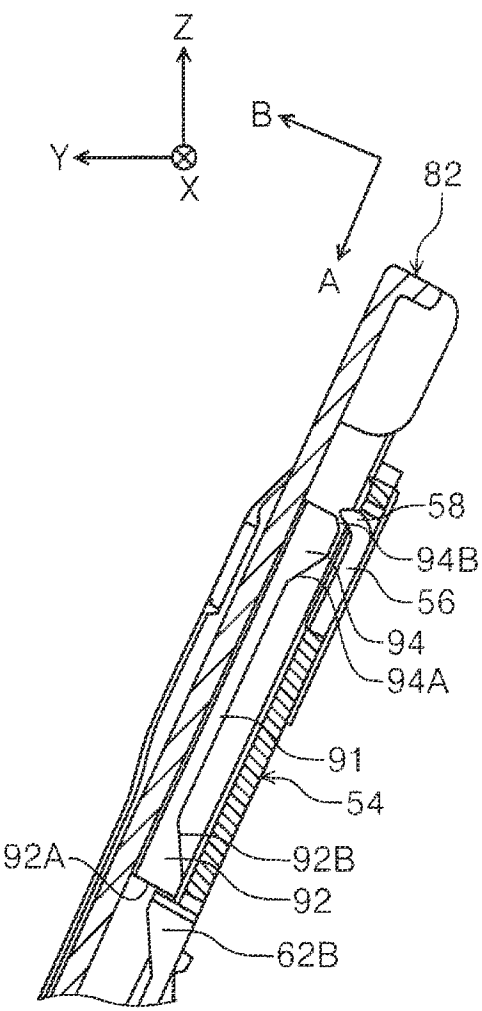
FIG. 12A is a cross-sectional side view of the paper support and the paper-supporting sub member in a housed state.

A state in which the paper support 82 is housed is illustrated in FIG. 12A. A state in which the paper support 82 is drawn out is illustrated in FIG. 12B. Based on understanding that the paper support 82 is drawn out in the −A direction, the supported portion 92 and the contact portion 94 will now be explained. The supported portion 92 protrudes in the −B direction from the rib 91. When viewed in the X-axis direction, the supported portion 92 has a trapezoidal shape. A supported surface 92A is formed on the +A directional end of the supported portion 92. The supported surface 92A is, for example, along the X-B plane. A sloped surface 92B is formed on the −A directional end of the supported portion 92. The sloped surface 92B extends in a direction that intersects with the A-axis direction and the B-axis direction. When the paper support 82 is in a housed state, the supported portion 92 is supported by the projection 62B. When the paper support 82 is in a drawn-out state, the supported portion 92 is supported by the protruding portion 58.

The contact portion 94 protrudes in the −B direction from the rib 91. A sloped surface 94A is formed on the +A directional end of the contact portion 94. The sloped surface 94A extends in a direction that intersects with the A-axis direction and the B-axis direction. A sloped surface 94B is formed on the −A directional end of the contact portion 94. The direction in which the sloped surface 94B extends intersects with the direction in which the sloped surface 94A extends. When the paper support 82 is in a housed state, the contact portion 94 is configured to be in contact with the protruding portion 58. The contact of the contact portion 94 with the protruding portion 58 keeps the paper support 82 at its housed position when an external force whose magnitude is not greater than a predetermined value acts on the paper support 82. If an external force whose magnitude is greater than the predetermined value acts on the paper support 82, the elastic portion 56 deforms elastically, and the elastic deformation brings the contact portion 94 and the protruding portion 58 out of the contact state and thus enables the paper support 82 to be drawn out.

Figure 13:
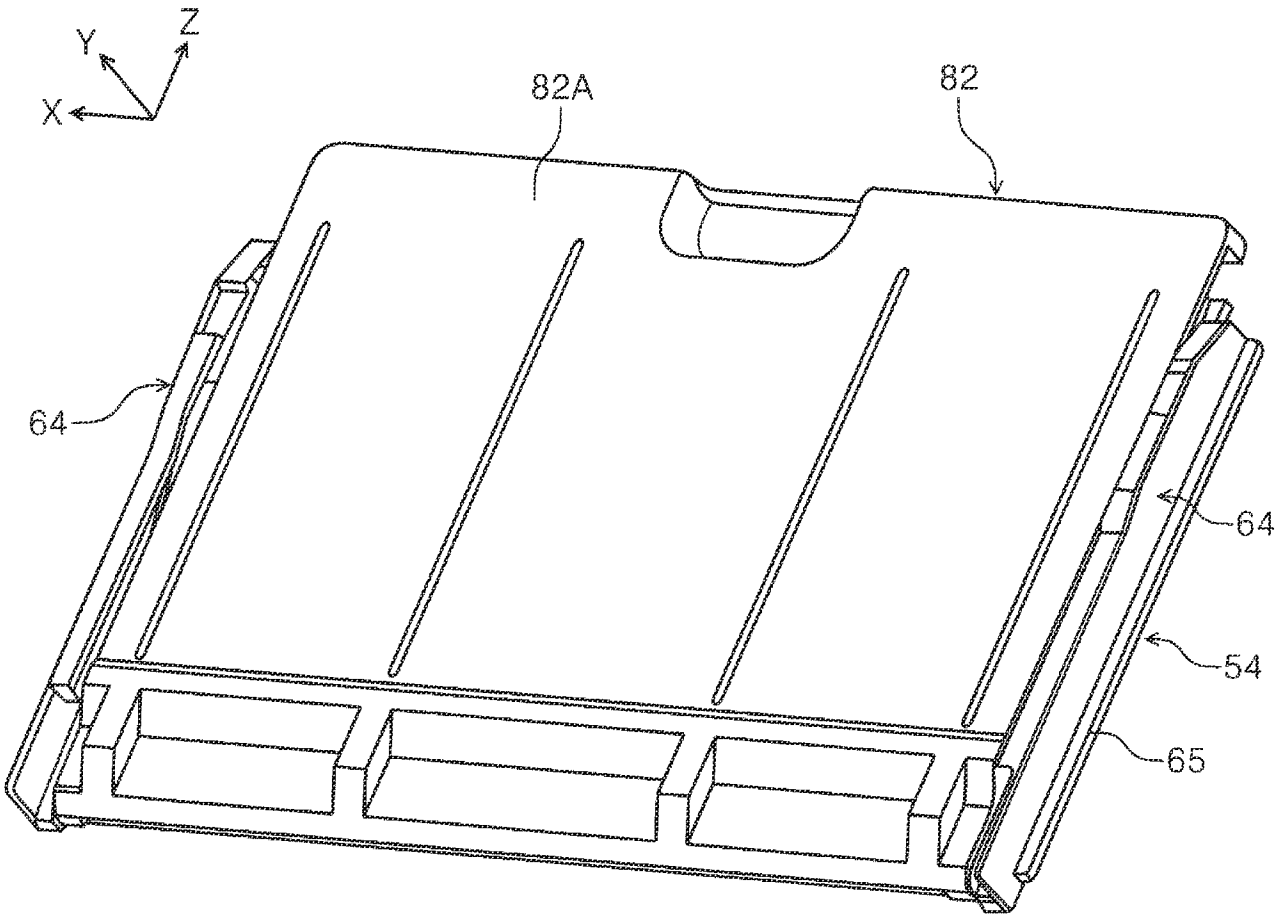
FIG. 13 is another perspective view of the paper support and the paper-supporting sub member.

As illustrated in FIG. 13, the paper support 82, when housed into the printer body 2 (FIG. 1), is held in the paper-supporting sub member 54. The paper support 82 and the paper-supporting sub member 54 are able to be drawn out for extension relatively with respect to, and housed inside, the open-and-close cover 32 (FIG. 1).

Figure 14:
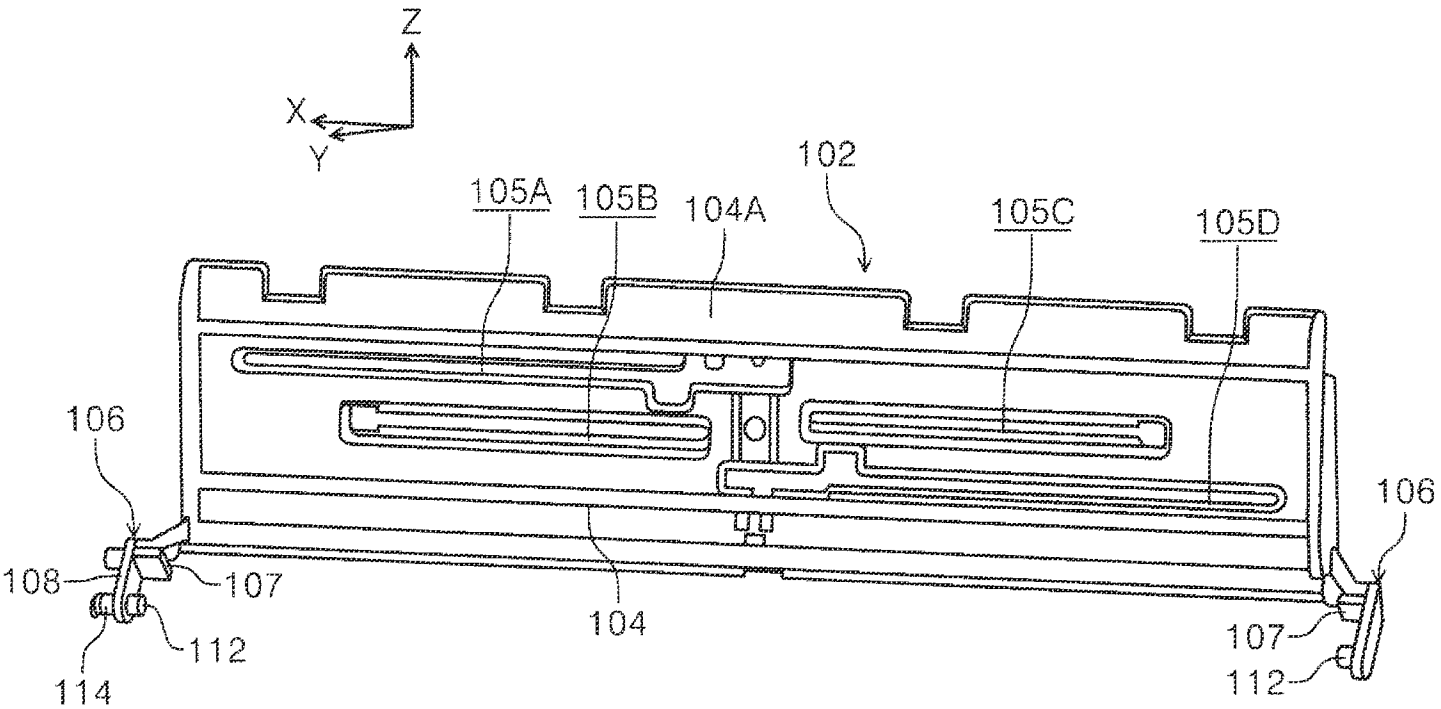
FIG. 14 is a perspective view of a support holder, showing its front surface.

As illustrated in FIG. 14, the support holder 102, which is an example of an assisting support member, is provided rotatably on the printer body 2. The support holder 102 includes a holder plate 104, an arm portion 106, a pivot portion 112, and a mounted portion 114. In the description of the support holder 102 below, a state in which the thickness direction of the holder plate 104 is the Y-axis direction is assumed. The holder plate 104 extends in the X-axis direction. The holder plate 104 has guide slits 105A, 105B, 105C, and 105D. Each of the guide slits 105A, 105B, 105C, and 105D extends in the X-axis direction and is configured as a through-hole slit through the holder plate 104 in the Y-axis direction. The guide slits 105A and 105B are located on the +X directional side with respect to the center of the holder plate 104 in the X-axis direction. The guide slits 105C and 105D are located on the −X directional side with respect to the center of the holder plate 104 in the X-axis direction. The guide slits 105A and 105B guide the +X-side sub edge guide 126 (FIG. 3), which will be described later, in the X-axis direction. The guide slits 105C and 105D guide the −X-side sub edge guide 126, which will be described later, in the X-axis direction. In other words, the two sub edge guides 126 are provided on the support holder 102. The +Y directional surface of the holder plate 104 will be hereinafter referred to as a front surface 104A. The front surface 104A is a surface on which a part of the paper P is placed. In other words, the front surface 104A is an example of a second supporting surface for supporting the paper P.

The arm portion 106 is formed on the −Z directional end of each of the two X directional ends of the holder plate 104. There is a substantial symmetry between the arm portion 106 on the +X directional side and the arm portion 106 on the −X directional side with respect to the center of the support holder 102 in the X-axis direction. Therefore, the arm portion 106 on the +X directional side will now be described. An explanation of the arm portion 106 on the −X directional side will be omitted. The arm portion 106 includes, for example, a first arm 107 and a second arm 108. The first arm 107 extends from the support holder 102 in the +X direction. The second arm 108 extends from the +X directional end of the first arm 107 in a direction that intersects with the Y-axis direction and the Z-axis direction. When the second arm 108 is directed in the Y-axis direction, the holder plate 104 is directed in the A-axis direction (FIG. 3). The pivot portion 112 protrudes in the −X direction from the second arm 108. The pivot portion 112 has a cylindrical shape having a center axis extending in the X-axis direction. The pivot portion 112 is supported rotatably by a wall 113 (FIG. 15) that constitutes a part of the printer body 2.

Figure 15:
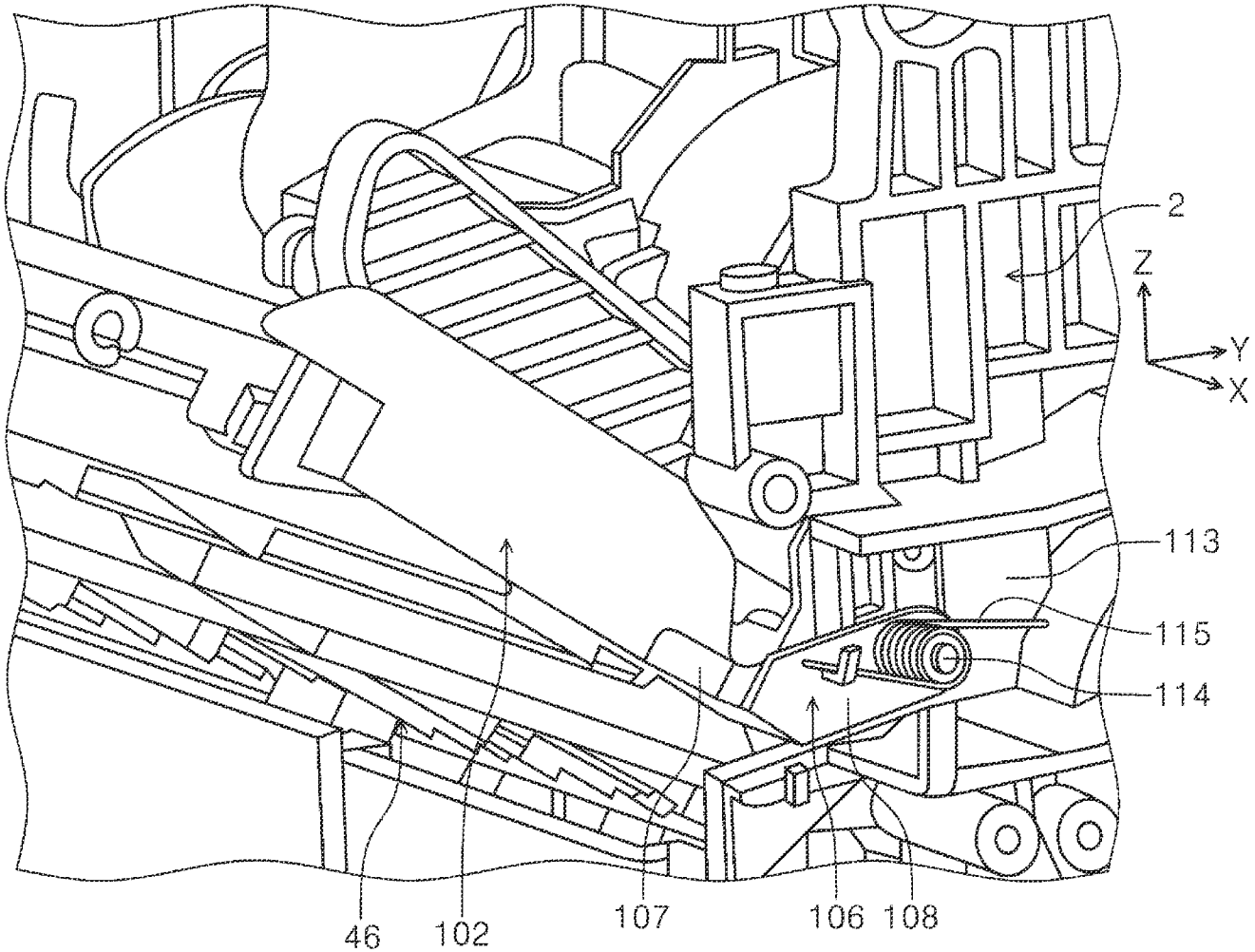
FIG. 15 is a perspective view of the hopper and the support holder in a tilted state, inclined with respect to the body.

As illustrated in FIG. 15, the mounted portion 114 protrudes in the +X direction from the second arm 108. The mounted portion 114 is formed on the +X-side second arm 108 only. A part of a second spring 115 is fixed to the mounted portion 114. In other words, the second spring 115 is provided on the support holder 102. The second spring 115 is an example of an urging member and is configured as a torsion spring. Another part of the second spring 115 fixed to the wall 113. The second spring 115 applies, to the support holder 102 as an urging force, a resilient force that acts when deformed. As described above, the second spring 115 urges the support holder 102 toward the open-and-close cover 32 (FIG. 3).

The holder plate 104 is put into an upright orientation along the Z axis and is housed into the printer body 2 when the support holder 102 is rotated in one direction around the center axis of the pivot portion 112 (FIG. 14). The holder plate 104 is put into a tilted orientation along the A axis and becomes exposed to the outside of the printer body 2 when the support holder 102 is rotated in the other direction around the center axis of the pivot portion 112. The upright orientation is an example of a first state. The tilted orientation is an example of a second state.

As described above, the support holder 102 is able to be housed into the printer body 2 and is able to rotate toward a position between the hopper 46 and the paper support 82 (FIG. 3) that is in a drawn-out state. The support holder 102, together with the hopper 46 and the paper support 82, supports the paper P. The support holder 102 is able to switch between an upright orientation for being housed into the printer body 2 and a tilted orientation for supporting the paper P together with the hopper 46 and the paper support 82. The opening/closing of the open-and-close cover 32 causes the support holder 102 to rotate and switch between the upright orientation and the tilted orientation.

The angle of inclination of the support holder 102 with respect to the X-Y plane is less than the angle of inclination of the paper support 82 with respect to the X-Y plane. Because of this structure, the paper placement surface formed by the support holder 102 and the paper support 82 is bent.

As described above, the support holder 102 rotates to switch between an upright orientation for being housed into the printer body 2 in a bent state in relation to the hopper 46 and a tilted orientation for supporting the paper P together with the hopper 46 and the paper support 82 in a drawn-out state, in which it is less bent than in the bent state.

Figure 16B:
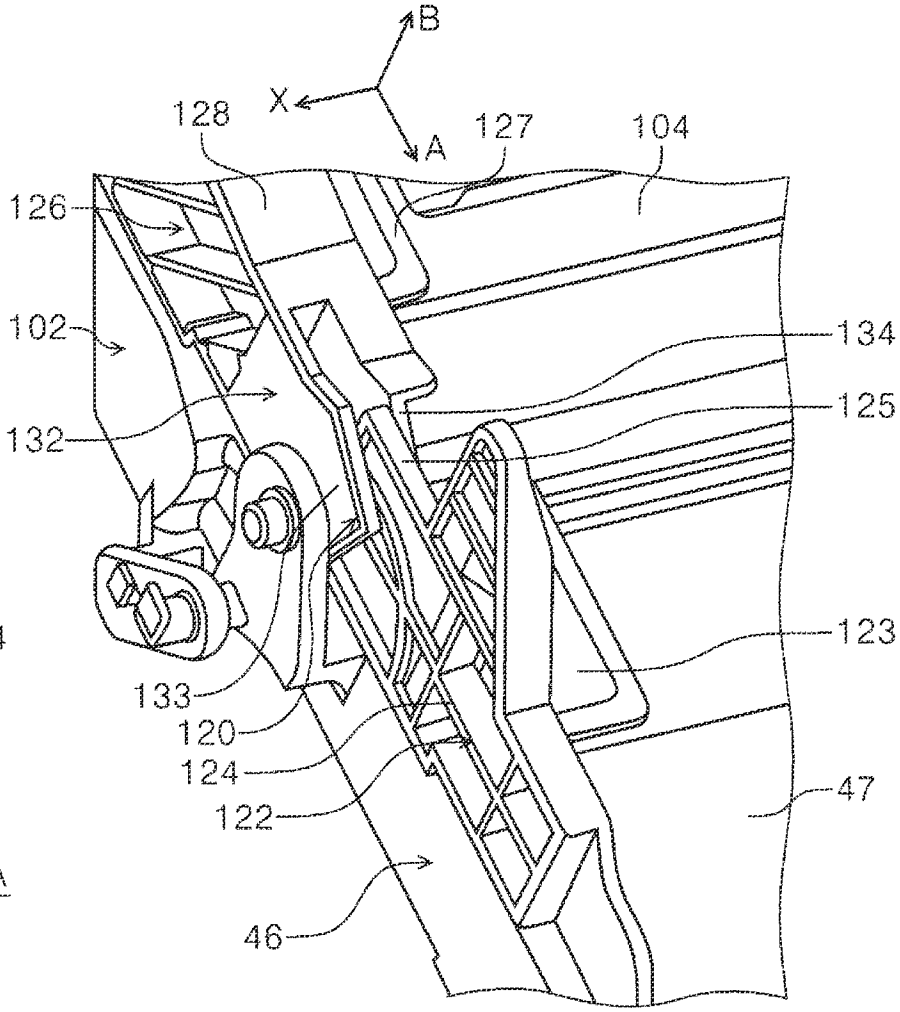
FIG. 16B is a perspective view of the edge guide and the sub edge guide.
Figure 16A:
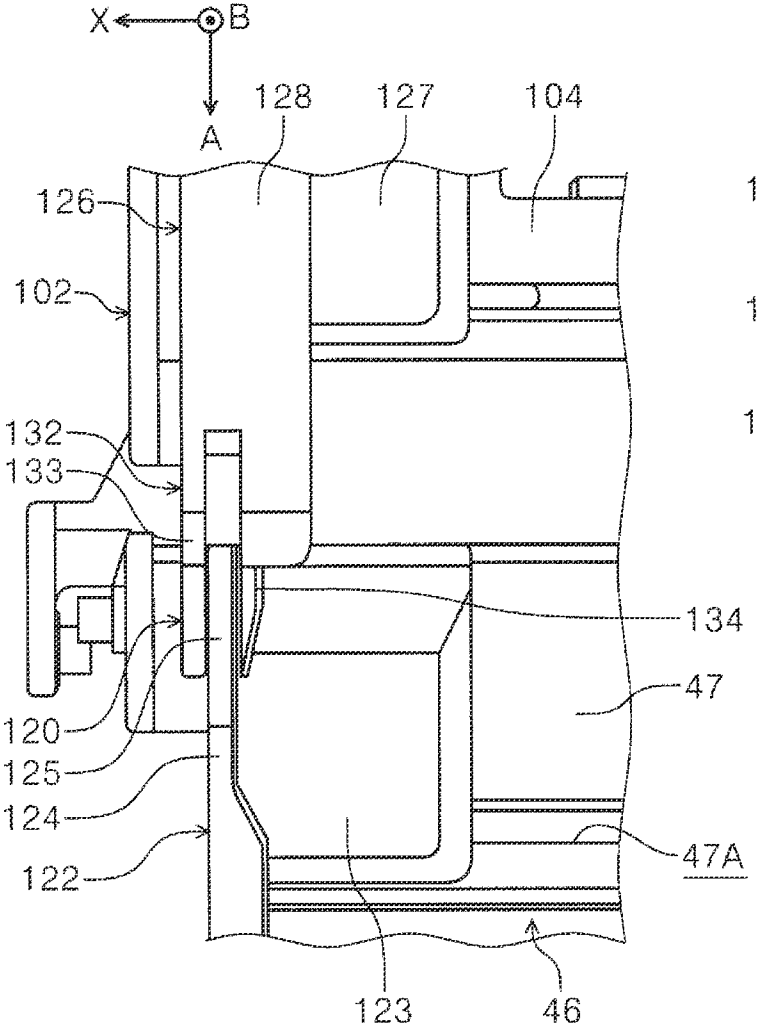
FIG. 16A is a plan view of an edge guide and a sub edge guide.

As illustrated in FIGS. 16A and 16B, the edge guides 122 are provided on the hopper 46. The edge guide 122 is an example of a first alignment member. One edge guide 122 is provided on the +X directional side. The other edge guide 122 is provided on the −X directional side. There is a substantial symmetry between the edge guide 122 on the +X directional side and the edge guide 122 on the −X directional side with respect to the center of the hopper 46 in the X-axis direction. Therefore, the edge guide 122 on the +X directional side is described here. An explanation of the edge guide 122 on the −X directional side will be omitted. The edge guides 122 are able to move in the X-axis direction, which intersects with the A-axis direction, and align both of the X directional edges of the paper P. Specifically, the edge guide 122 includes a bottom wall portion 123 and a vertical wall portion 124.

The bottom wall portion 123 has a plate shape having a predetermined thickness in the B-axis direction. The bottom wall portion 123 is located on the hopper plate 47. A non-illustrated leg portion that is guided along the guide slit 47A and a non-illustrated rack member that supports the leg portion are provided on the bottom wall portion 123. The rack member moves in the X-axis direction when a non-illustrated pinion rotates. As a result, the two bottom wall members 123 come close to each other or go away from each other in the X-axis direction. The vertical wall portion 124 is upright in the +B direction on the +X directional end of the bottom wall portion 123. A plate portion 125 that has a predetermined thickness in the X-axis direction is formed on the −A directional end of the vertical wall portion 124. The plate portion 125 extends to the −A directional end of the hopper plate 47.

The sub edge guides 126 are provided on the support holder 102. The sub edge guide 126 is an example of a second alignment member. One sub edge guide 126 is provided on the +X directional side. The other sub edge guide 126 is provided on the −X directional side. There is a substantial symmetry between the sub edge guide 126 on the +X directional side and the sub edge guide 126 on the −X directional side with respect to the center of the support holder 102 in the X-axis direction. Therefore, the sub edge guide 126 on the +X directional side is described here. An explanation of the sub edge guide 126 on the −X directional side will be omitted. The sub edge guides 126 are able to move in the X-axis direction and align both of the X directional edges of the paper P. Specifically, the sub edge guide 126 includes a bottom wall portion 127 and a vertical wall portion 128.

The bottom wall portion 127 has a plate shape having a predetermined thickness in the B-axis direction. The bottom wall portion 127 is located on the holder plate 104. A non-illustrated leg portion that is guided along the guide slits 105A and 105B (FIG. 14) and a non-illustrated rack member that supports the leg portion are provided on the bottom wall portion 127. The rack member moves in the X-axis direction when a non-illustrated pinion rotates. As a result, the two bottom wall members 127 come close to each other or go away from each other in the X-axis direction. The vertical wall portion 128 is upright in the +B direction on the +X directional end of the bottom wall portion 127. An inserted portion 132 that is open in the +A direction is formed on the +A directional end of the vertical wall portion 128.

The inserted portion 132 has a shape of a letter U when viewed in the B-axis direction. Specifically, the inserted portion 132 is made up of the vertical wall portion 128, an outer wall portion 133 extending in the +A direction from the +X directional end of the vertical wall portion 128, and an inner wall portion 134 extending in the +A direction from, of the vertical wall portion 128, a position that is located relatively on the −X directional side in comparison with the outer wall portion 133. The plate portion 125 and the inserted portion 132 constitute a linkage portion 120. In other words, the linkage portion 120 is formed on the edge guide 122 and the sub edge guide 126. In the linkage portion 120, the plate portion 125 is inserted between the outer wall portion 133 and the inner wall portion 134. Because of this structure, when the edge guide 122 is moved in one direction or the other direction along the X axis, the plate portion 125 comes into contact with the outer wall portion 133 or the inner wall portion 134, and, as a result, the sub edge guide 126 is also moved in one direction or the other direction along the X axis. That is, linked with the movement of the edge guide 122, the sub edge guide 126 moves. There is a clearance between the outer wall portion 133 and the plate portion 125 in the X-axis direction. There is a clearance between the plate portion 125 and the inner wall portion 134 in the X-axis direction. Because of this structure, in the linkage portion 120, the sub edge guide 126 is able to rotate freely in relation to the edge guide 122.

Next, the operation of each component of the printer 1 will now be explained.

Figure 17A:
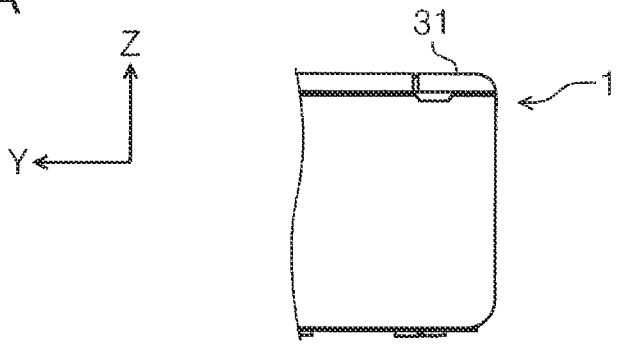
FIG. 17A is a side view illustrating that each member is in a housed state.
Figure 17B:
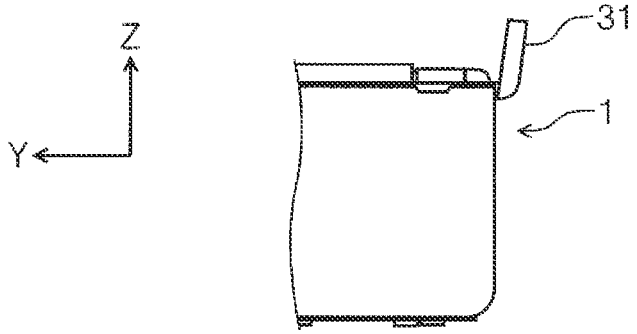
FIG. 17B is a side view illustrating a state in which an upper cover has been opened.
Figure 17C:
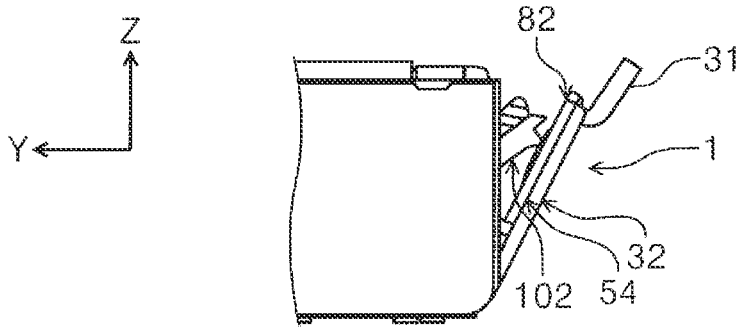
FIG. 17C is a side view illustrating a state in which the open-and-close cover has been tilted.
Figure 18:
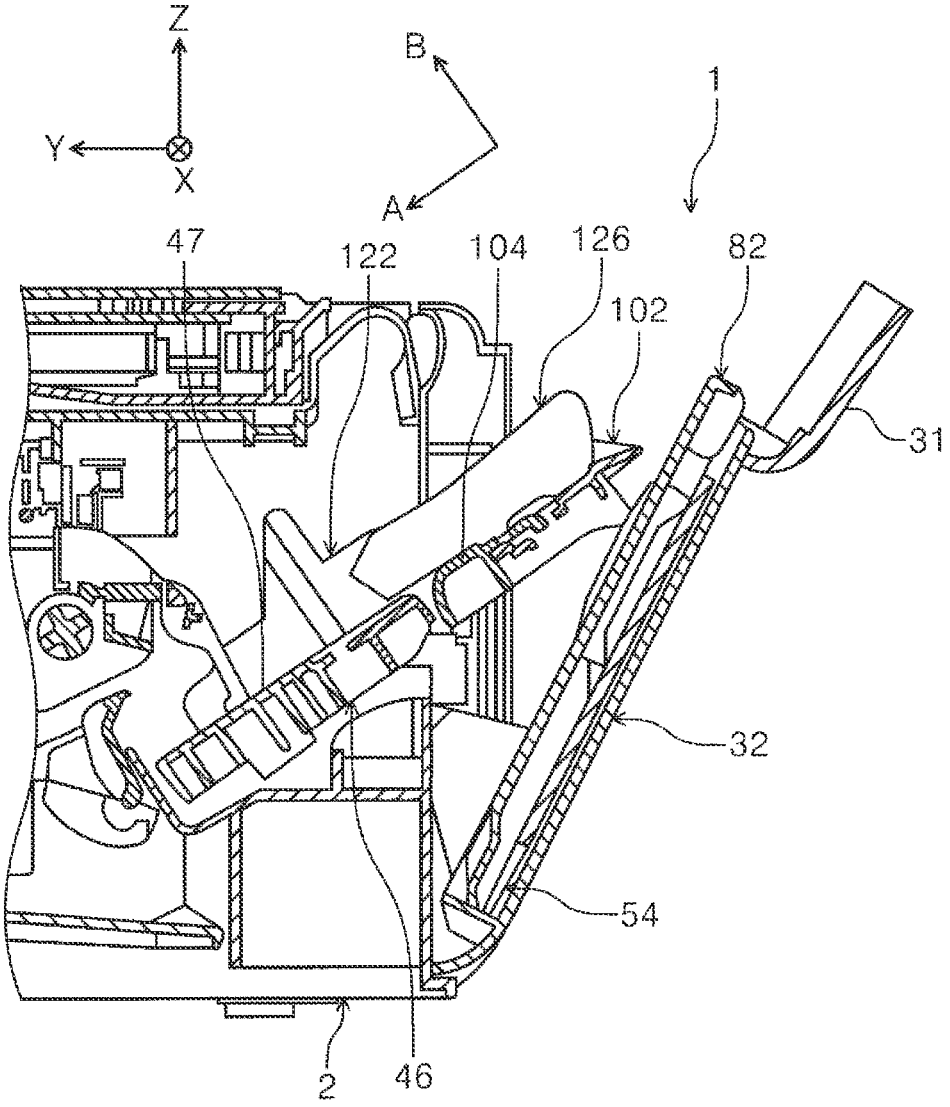
FIG. 18 is a cross-sectional side view illustrating a state before the paper support and the paper-supporting sub member are drawn out for extension.

In FIG. 17A, a state in which each component of the printer 1 is housed is illustrated. Next, as illustrated in FIG. 17B, the upper cover 31 is rotated. Then, as illustrated in FIG. 17C, the open-and-close cover 32 is tilted toward the −Y directional side. The tilting of the open-and-close cover 32 makes the paper support 82, the paper-supporting sub member 54, and the hopper 46 (FIG. 3) exposed. Since an opposing force that acts from the open-and-close cover 32 onto the support holder 102 becomes weaker than an urging force applied by the second spring 115 (FIG. 15), the support holder 102 is rotated toward, that is, tilted toward, the paper support 82. A non-illustrated stopper provided on the printer body 2 stops the rotation of the support holder 102 as illustrated in FIG. 18. This brings the holder plate 104 into line with the hopper plate 47 in the A-axis direction. Therefore, the support holder 102 and the hopper 46 become able to receive the paper P.

Next, as illustrated in FIG. 12B, when the paper support 82 is pulled out in the +Z direction, first, due to the contact of the supported portion 92 with the protruding portion 58, the paper-supporting sub member 54 is pulled out in he +Z direction in relation to the open-and-close cover 32 (FIG. 3). Then, the operation of pulling the paper-supporting sub member 54 out is stopped due to the engagement of the engagement portion 61 (FIG. 9) with the restriction ribs 43 (FIG. 4). When the operation of pulling the paper-supporting sub member 54 out is stopped, the operation of pulling the paper support 82 out continues.

Figure 19B:
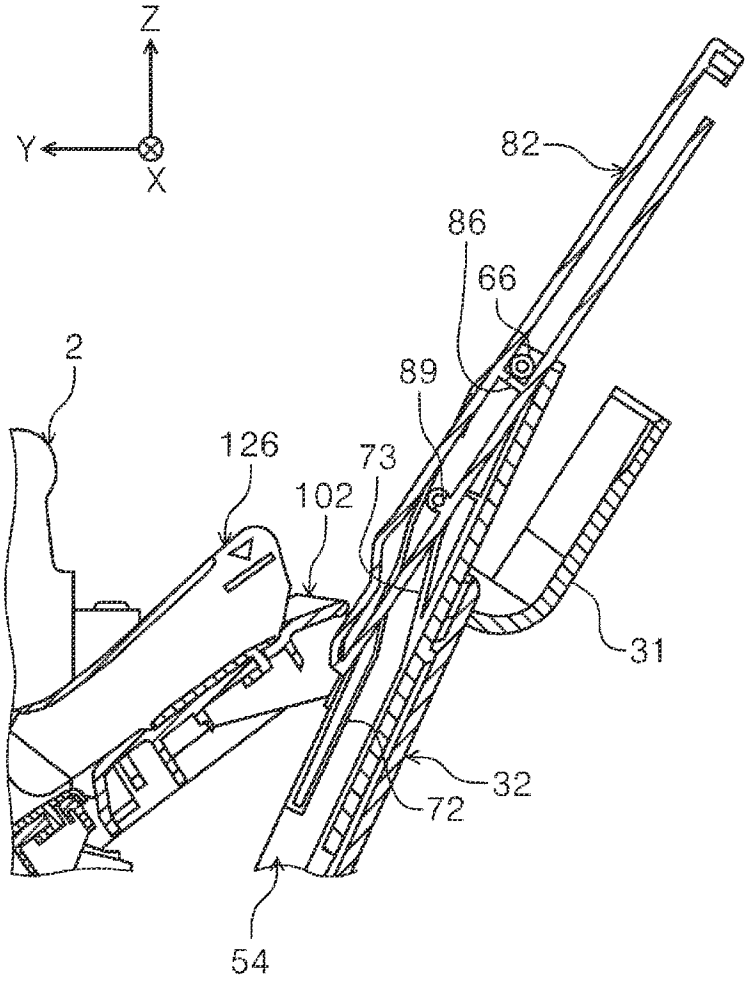
FIG. 19B is a cross-sectional side view illustrating a state in which the paper support is being tilted.
Figure 19A:
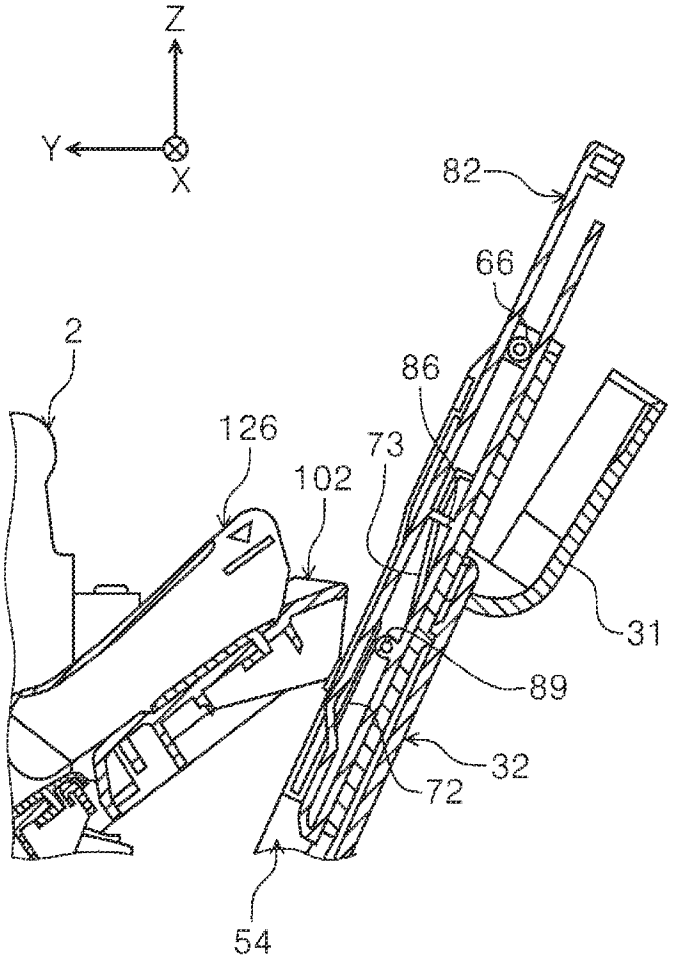
FIG. 19A is a cross-sectional side view illustrating a state in which the paper support is being drawn out.

Next, as illustrated in FIGS. 19A and 19B, the second boss 89 goes into the second guide portion 73 from the first guide portion 72 and is guided by the second guide portion 73. Since the first boss 66 is fixed, the paper support 82 is rotated around the center axis of the first boss 66. That is, the paper support 82 is put into a tilted orientation by being rotated in such a way that its −Z directional end is raised in the +Z direction. The tilting makes the gap between the support holder 102 and the paper support 82 in the Y-axis direction narrower and makes the level difference between the support holder 102 and the paper support 82 smaller.

Figure 17D:
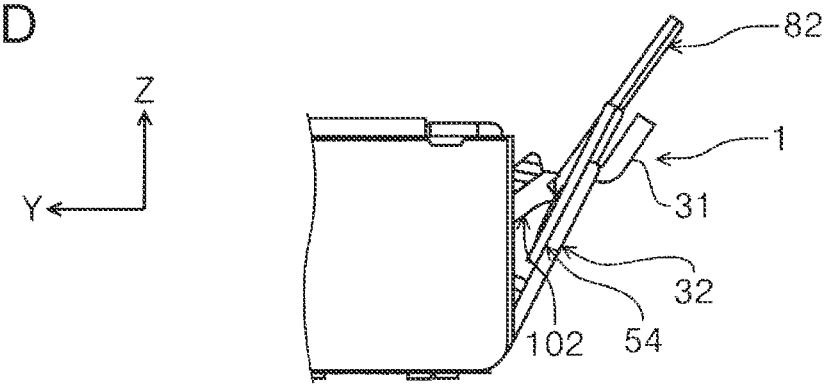
FIG. 17D is a side view illustrating a state in which the members have been opened, drawn out, and extended.
Figure 20:
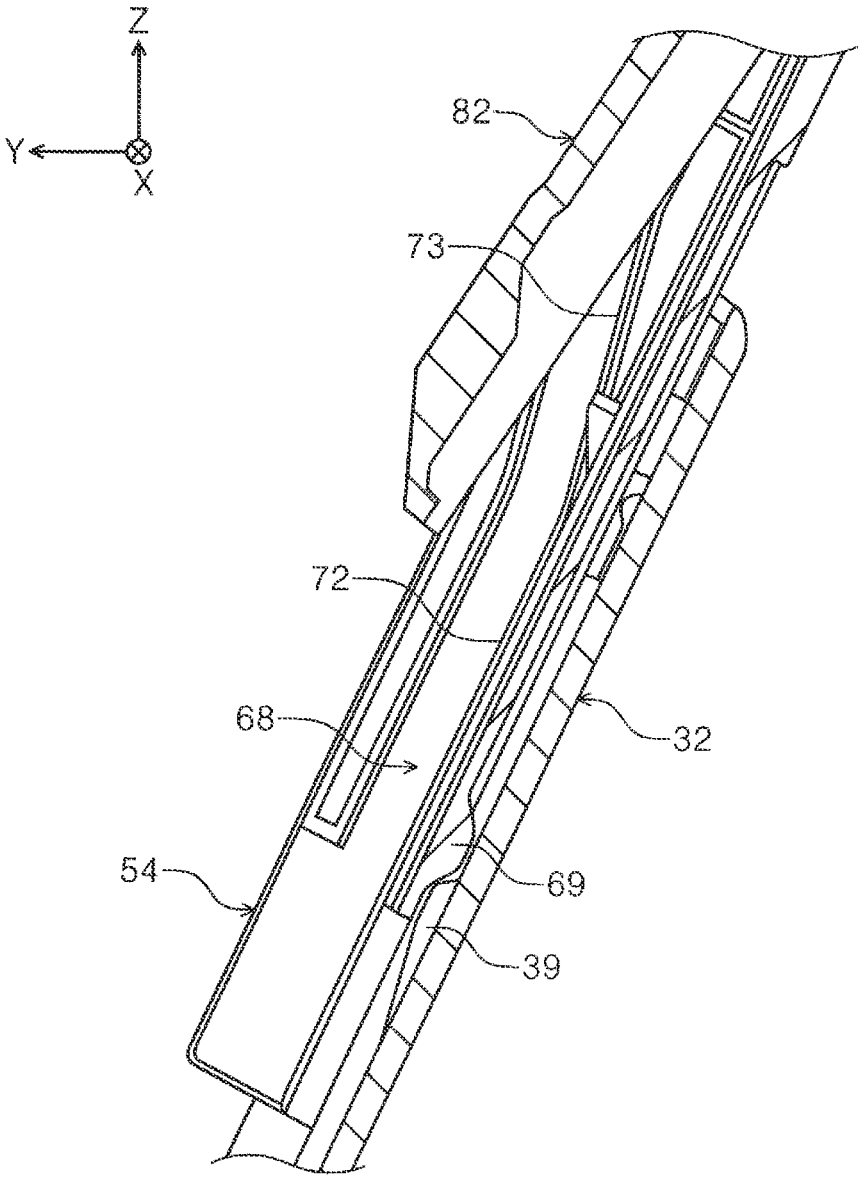
FIG. 20 is a cross-sectional side view illustrating a state in which the convex portion of the open-and-close cover is in contact with the bulged portion of the paper-supporting sub member.

As illustrated in FIG. 20, the paper-supporting sub member 54 is kept in a drawn-out state because the bulged portion 69 is supported by the convex portion 39. As illustrated in FIG. 12B, the paper support 82 is kept in a drawn-out state because the supported portion 92 is supported by the protruding portion 58. In this way, as illustrated in FIG. 17D, the open-and-close cover 32, the upper cover 31, the paper-supporting sub member 54, the paper support 82, and the support holder 102 are kept in an opened, drawn-out, and extended state. These components are housed into the printer body 2 by going through reverse steps that are the opposite of the above steps.

As explained above, in the printer 1, the paper support 82 becomes able to support the paper P as a result of drawing the paper support 82 out when the open-and-close cover 32 is in an open state. The support holder 102, by being rotated toward a position between the hopper 46 and the paper support 82, is switched from an upright orientation that is its orientation when housed to a tilted orientation that is its orientation when drawn out, and supports the paper P together with the hopper 46 and the paper support 82. Since the support holder 102 is switched into a tilted orientation by rotation as described above, the area where it is possible to support the paper P is wider as compared with a structure that is not equipped with the support holder 102. Therefore, it is possible to prevent the shortage of the area for supporting the paper P. The support holder 102 is rotated in linkage with the operation of closing the open-and-close cover 32, and this rotation causes the support holder 102 to switch from a tilted orientation to an upright orientation and to be housed into the printer body 2. As compared with a structure in which the support holder 102 and the paper support 82 are configured integrally, the space required for housing the support holder 102 and the paper support 82 inside the printer body 2 can be reduced. Since a smaller space is sufficient, it is possible to prevent the size of the printer 1 from increasing.

In the printer 1, the paper-supporting sub member 54 is moved in relation to the open-and-close cover 32, and the paper support 82 is drawn out in relation to the paper-supporting sub member 54. Therefore, as compared with a structure in which the paper support 82 is drawn out directly from the open-and-close cover 32, it is possible to cause the paper support 82 to move to a higher position in the Z-axis direction. This makes it possible to increase the size of the area where the paper P is supported. In the printer 1, when the paper support 82 is drawn out, the Z directional lower end portion of the front surface 82A of the paper support 82 is guided to a position that is continuous from the Z directional upper end portion of the front surface 104A of the support holder 102. That is, the paper support 82 approaches the support holder 102. Therefore, it is possible to make the gap between the support holder 102 and the paper support 82 narrower.

In the printer 1, the paper support 82 is guided to its drawn-out position along the guide rail 68. As a result, the paper support 82 approaches the support holder 102. Moreover, since the orientation of the paper support 82 is changed in such a way as to approach the support holder 102 by being rotated around the center axis of the first boss 66, it is possible to further reduce the gap between the support holder 102 and the paper support 82. In the printer 1, the paper-supporting sub member 54 and the open-and-close cover 32 are non-integrated members separated from each other. As compared with a structure in which the paper-supporting sub member 54 and the open-and-close cover 32 are configured integrally, it is possible to provide the first boss 66, which supports the paper support 82 rotatably, at a higher position in the +Z direction. Therefore, there is no need to make the angle of tilting of the paper support 82 with respect to the Z direction large.

In the printer 1, moving the paper support 82 along the second guide portion 73 brings the paper support 82 closer to the support holder 102. Since it is possible to move the paper support 82 along the second guide portion 73 in one step without any need for movement in two steps in two directions that are orthogonal to each other, it is easier to move the paper support 82 to the drawn-out position. In the printer 1, since the paper-supporting sub member 54 drawn out is held by the convex portion 39, it is possible to prevent the paper-supporting sub member 54 from returning to its housed position before drawing-out operation finishes.

In the printer 1, since the supported portion 92 is supported by the protruding portion 58 when the paper support 82 is in a drawn-out state, the paper support 82 is prevented from moving toward its housed position. This prevents the displacement of the paper support 82 in a drawn-out state with respect to the paper-supporting sub member 54. In the printer 1, in a state in which the paper support 82 is drawn out in relation to the paper-supporting sub member 54, when the protruding portion 58 is pushed by the supported portion 92 in a direction of going away from the paper support 82, the elastic portion 56 deforms elastically in a direction of going away from the paper support 82, thereby absorbing the pushing force applied from the supported portion 92. This prevents the deformation of the protruding portion 58 from occurring when the paper support 82 is drawn out.

In the printer 1, since the contact of the contact portion 94 with the protruding portion 58 limits the movement of the paper support 82 with respect to the paper-supporting sub member 54, it is possible to keep the paper support 82 in a housed state. In the printer 1, in a state in which the support holder 102 constitutes a part of the transportation path K, when either one of the edge guide 122 and the sub edge guide 126 is moved, the other of them is also moved by the linkage portion 120. This makes the alignment of the paper P by the edge guide 122 and the sub edge guide 126 easier. Moreover, in the linkage portion 120, the sub edge guide 126 is able to rotate freely in relation to the edge guide 122, and, the free relative rotation makes it possible to prevent the edge guide 122 from obstructing the operation of the support holder 102 when the support holder 102 is rotated to be housed into the printer body 2.

In the printer 1, when the open-and-close cover 32 is in a closed state, the open-and-close cover 32 resists the urging force of the second spring 115. When the open-and-close cover 32 is opened, the support holder 102 is rotated due to the urging force of the second spring 115. Since opening the open-and-close cover 32 causes the rotation of the support holder 102 automatically, the operation of rotating the support holder 102 manually is unnecessary. In the printer 1, the lubricant G reduces the force of friction caused by the contact of the open-and-close cover 32 and the first spring 24. Moreover, since the restricting portion 42 restricts the movement of the lubricant G when the lubricant G moves in a direction intersecting with a spring-pushing direction due to the action of a pushing force applied by the first spring 24, it is possible to prevent the lubricant G from going to the outside of the region of contact of the open-and-close cover 32 and the first spring 24.

Although the printer 1 according to an exemplary embodiment of the present disclosure has basically the structure described above, of course, partial changes in structure, omission, etc. can be made within a range of not departing from the gist of the present disclosure. Some modification examples will now be explained.

In the printer 1, instead of using the paper-supporting sub member 54, the support holder 102 may be further tilted such that the support holder 102 approaches the paper support 82. The paper-supporting sub member 54 may have the guide rail 68 only. The guide rail 68 may have a curved portion instead of a sloped portion like the second guide portion 73. The convex portion 39 may be omitted from the open-and-close cover 32. For example, the paper-supporting sub member 54 may be held in position by pushing a convex portion formed on the paper-supporting sub member 54 against the open-and-close cover 32.

Instead of using the protruding portion 58 and the supported portion 92, for example, magnets that attract each other may be provided on the paper support 82 and the paper-supporting sub member 54 respectively to prevent the displacement of the paper support 82. The elastic portion 56 may be omitted by making the protruding portion 58 elastically deformable. Instead of providing the protruding portion 58 on the paper-supporting sub member 54, a recessed portion may be formed in the paper-supporting sub member 54, and the paper support 82 may be kept in a housed state by bringing the contact portion 94 into engagement with the recessed portion. The edge guide 122 and the sub edge guide 126 may be distanced from each other, and the linkage portion 120 may be omitted. The support holder 102 may be tilted manually instead of being urged by the second spring 115. Instead of using the lubricant G, a sheet material that has a low coefficient of friction may be provided on the open-and-close cover 32, and the first spring 24 may be in contact with the sheet material.

In order to increase the size of an area where the paper P is placed, the paper support 82 may be made up two or more members that are able to move in relation to each other in the Z direction. The upper cover 31 may be provided on the printer body 2, instead of the open-and-close cover 32. The open-and-close member is not limited to a member that serves as an exterior cover of the printer 1 such as the open-and-close cover 32. The open-and-close member may be configured to open and close for the transportation path K at a +Y directional position in comparison with the −Y directional end of the printer body 2. The open-and-close cover 32 may be configured to switch between an open state and a closed state by sliding in the Y direction. The hopper 46 is not limited to a rotatable hopper. The hopper 46 may be configured to slide.

What is claimed is:

1. An image forming apparatus, comprising:

an apparatus body that includes an image forming unit that forms an image on a medium;

an open-and-close member that is provided on the apparatus body and is configured to rotate about a pivot between an open state in which the open-and-close member is opened from the apparatus body and a closed state in which the open-and-close member is closed toward the apparatus body; and an urging mechanism that is configured to push the open-and-close member in an opening direction when the open-and-close member is in the open state and restrict rotation of the open-and-close member in the opening direction when the open-and-close member is in the closed state.

2. The image forming apparatus according to claim 1, wherein the urging mechanism is configured to hold the open-and-close member in the closed state.

3. The image forming apparatus according to claim 1, wherein the urging mechanism includes a spring.

4. The image forming apparatus according to claim 3, wherein the spring is a torsion spring.

5. The image forming apparatus according to claim 1, wherein the urging mechanism is provided outward of the pivot in a width direction of the apparatus body.

6. The image forming apparatus according to claim 3, wherein the urging mechanism is provided outward of the pivot in a width direction of the apparatus body.

7. The image forming apparatus according to claim 1, wherein the urging mechanism includes a spring coated with a lubricant and has a restricting portion that restricts movement of the lubricant.

* * * * *